US012345117B2

(12) United States Patent
Greci et al.

(10) Patent No.: US 12,345,117 B2
(45) Date of Patent: Jul. 1, 2025

(54) INDIVIDUAL SEPARATE CHUNKS OF EXPANDABLE METAL

(71) Applicant: Halliburton Energy Services, Inc., Houston, TX (US)

(72) Inventors: Stephen Michael Greci, Carrollton, TX (US); Michael Linley Fripp, Carrollton, TX (US); Brandon T. Least, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/334,363

(22) Filed: May 28, 2021

(65) Prior Publication Data

US 2022/0381106 A1 Dec. 1, 2022

(51) Int. Cl.
*E21B 33/12* (2006.01)
*E21B 33/13* (2006.01)

(52) U.S. Cl.
CPC ..... *E21B 33/1208* (2013.01); *E21B 33/13* (2013.01)

(58) Field of Classification Search
CPC ..... E21B 33/13; E21B 33/1208
See application file for complete search history.

(56) References Cited

U.S. PATENT DOCUMENTS

| | | | |
|---|---|---|---|
| 1,525,740 | A | 2/1925 | Howard |
| 2,075,912 | A | 4/1937 | Roye |
| 2,590,931 | A | 4/1952 | Cabaniss |
| 2,743,781 | A | 5/1956 | Lane |
| 2,865,454 | A | 12/1958 | Richards |
| 3,206,536 | A | 9/1965 | Goodloe |
| 3,371,716 | A | 3/1968 | Current |
| 3,616,354 | A | 10/1971 | Russell |
| 3,706,125 | A | 12/1972 | Hopkins |
| 4,270,608 | A | 6/1981 | Hendrickson |
| 4,424,859 | A | 1/1984 | Sims |
| 4,424,861 | A | 1/1984 | Carter |
| 4,442,908 | A | 4/1984 | Steenbock |
| 4,446,932 | A | 5/1984 | Hipp |
| 4,457,379 | A | 7/1984 | McStravick |
| 4,527,815 | A | 7/1985 | Frick |
| 4,977,636 | A | 12/1990 | King |

(Continued)

FOREIGN PATENT DOCUMENTS

| | | | |
|---|---|---|---|
| CA | 2820742 | A1 | 9/2013 |
| CN | 203308412 | U | 11/2013 |

(Continued)

OTHER PUBLICATIONS

Fripp, et al. "Novel Expanding Metal Alloy for Non-Elastomeric Sealing and Anchoring." Paper presented at the SPE Annual Technical Conference and Exhibition, Houston, Texas, USA, Oct. 2022. doi: https://doi.org/10.2118/210273-MS (Year: 2022).*

*Primary Examiner* — Theodore N Yao
(74) *Attorney, Agent, or Firm* — Scott Richardson; Parker Justiss, P.C.

(57) ABSTRACT

Provided is a downhole tool, a method for sealing within a well system, and a well system. The downhole tool, in at least one aspect, includes a tubular, and a collection of individual separate chunks of expandable metal positioned about the tubular, the collection of individual separate chunks of expandable metal comprising a metal configured to expand in response to hydrolysis.

13 Claims, 19 Drawing Sheets

(56) References Cited

U.S. PATENT DOCUMENTS 4,979,585 A 12/1990 Chesnutt
5,139,274 A 8/1992 Oseman
5,220,959 A 6/1993 Vance
5,424,139 A 6/1995 Shuler
5,492,173 A 2/1996 Kilgore
5,517,981 A 5/1996 Taub et al.
5,662,341 A 9/1997 Ezell et al.
5,667,015 A 9/1997 Harestad
5,803,173 A 9/1998 Fraser et al.
6,089,320 A 7/2000 LaGrange
6,106,024 A 8/2000 Herman et al.
6,840,325 B2 1/2005 Stephenson
6,907,930 B2 6/2005 Cavender
6,942,039 B2 9/2005 Tinker
7,104,322 B2 9/2006 Whanger et al.
7,152,687 B2 12/2006 Gano
7,322,408 B2 1/2008 Howlett
7,347,274 B2 3/2008 Patel
7,350,590 B2 4/2008 Hosie et al.
7,402,277 B2 7/2008 Ayer
7,578,043 B2 8/2009 Simpson et al.
7,673,688 B1 3/2010 Jones
7,677,303 B2 3/2010 Coronado
7,696,275 B2 4/2010 Slay et al.
7,963,321 B2 6/2011 Kutac
7,996,945 B2 8/2011 Nosker
8,042,841 B2 10/2011 Viegener
8,109,339 B2 2/2012 Xu
8,225,861 B2 7/2012 Foster et al.
8,266,751 B2 9/2012 He
8,430,176 B2 4/2013 Xu
8,453,736 B2 6/2013 Constantine
8,459,367 B2 6/2013 Nutley et al.
8,469,084 B2 6/2013 Clark et al.
8,490,707 B2 7/2013 Robisson
8,579,024 B2 11/2013 Mailand et al.
8,684,096 B2 4/2014 Harris
8,794,330 B2 8/2014 Stout
8,807,209 B2 8/2014 King
8,875,800 B2 11/2014 Wood et al.
8,894,070 B2 11/2014 Bhat et al.
8,993,491 B2 3/2015 James
9,004,173 B2 4/2015 Richard
9,217,311 B2 12/2015 Slup
9,249,904 B2 2/2016 Duquette
9,279,295 B2 3/2016 Williamson et al.
9,347,272 B2 5/2016 Hewson et al.
9,353,606 B2 5/2016 Bruce et al.
9,393,601 B2 7/2016 Ranck
9,404,030 B2 8/2016 Mazyar
9,534,460 B2 1/2017 Watson et al.
9,611,715 B1 4/2017 Smith
9,644,459 B2 5/2017 Themig
9,708,880 B2 7/2017 Solhaug
9,725,979 B2 8/2017 Mazyar et al.
9,732,578 B2 8/2017 McRobb
9,745,451 B2 8/2017 Zhao et al.
9,765,595 B2 9/2017 Themig et al.
9,771,510 B2 9/2017 James et al.
9,945,190 B2 4/2018 Crowley
9,976,380 B2 5/2018 Davis et al.
9,976,381 B2 5/2018 Martin et al.
10,030,467 B2 7/2018 Al-Gouhi
10,060,225 B2 8/2018 Wolf
10,119,011 B2 11/2018 Zhao et al.
10,179,873 B1 1/2019 Meng
10,316,601 B2 6/2019 Walton et al.
10,337,298 B2 7/2019 Braddick
10,344,570 B2 7/2019 Steele
10,352,109 B2 7/2019 Sanchez
10,364,636 B2 7/2019 Davis
10,472,933 B2 11/2019 Steele
10,533,392 B2 1/2020 Walton et al.
10,718,183 B2 7/2020 Bruce et al.
10,758,974 B2 9/2020 Sherman
10,794,152 B2 10/2020 Lang et al.
10,961,804 B1 3/2021 Fripp
11,359,448 B2 6/2022 Fripp
11,365,611 B2 6/2022 Gibb
11,428,066 B2 8/2022 Andersen
11,512,552 B2 11/2022 Fripp
2002/0088616 A1 7/2002 Swor et al.
2003/0132001 A1 7/2003 Wilson
2003/0164236 A1 9/2003 Thornton
2003/0164237 A1 9/2003 Butterfield, Jr.
2003/0205377 A1 11/2003 Streater
2004/0194970 A1 10/2004 Eatwell
2005/0051333 A1 3/2005 Weber
2005/0061369 A1 3/2005 De Almeida
2005/0072576 A1 4/2005 Henriksen
2005/0093250 A1 5/2005 Santi et al.
2005/0199401 A1 9/2005 Patel et al.
2006/0042801 A1 3/2006 Hackworth et al.
2006/0144591 A1 7/2006 Gonzalez
2006/0272806 A1 12/2006 Wilkie et al.
2007/0089875 A1 4/2007 Steele et al.
2007/0089910 A1 4/2007 Hewson et al.
2007/0095532 A1 5/2007 Head
2007/0137826 A1 6/2007 Bosma et al.
2007/0144734 A1 6/2007 Xu et al.
2007/0151724 A1 7/2007 Ohmer et al.
2007/0163781 A1 7/2007 Walker
2007/0221387 A1 9/2007 Levy
2007/0246213 A1 10/2007 Hailey
2007/0267824 A1 11/2007 Baugh et al.
2007/0277979 A1 12/2007 Todd et al.
2008/0047708 A1 2/2008 Spencer
2008/0135249 A1 6/2008 Fripp
2008/0149351 A1 6/2008 Marya
2008/0290603 A1 11/2008 Laflin
2009/0014173 A1 1/2009 Macleod
2009/0084555 A1 4/2009 Lee
2009/0102133 A1 4/2009 Ruddock
2009/0159278 A1 6/2009 Corre
2009/0200028 A1* 8/2009 Dewar ..... E21B 27/02 166/162
2009/0250227 A1 10/2009 Brown et al.
2009/0250228 A1 10/2009 Loretz
2009/0272546 A1 11/2009 Nutley et al.
2009/0321087 A1* 12/2009 Victorov ..... E21B 33/1208 264/319
2010/0072711 A1 3/2010 Doane
2010/0078173 A1 4/2010 Buytaert et al.
2010/0096143 A1 4/2010 Angman
2010/0108148 A1 5/2010 Chen
2010/0122819 A1 5/2010 Wildman
2010/0139930 A1* 6/2010 Patel ..... E21B 33/1208 166/387
2010/0155083 A1 6/2010 Lynde et al.
2010/0181080 A1 7/2010 Levy
2010/0225107 A1 9/2010 Tverlid
2010/0257913 A1 10/2010 Storm, Jr. et al.
2010/0307737 A1 12/2010 Mellemstrand
2011/0061876 A1 3/2011 Johnson et al.
2011/0098202 A1 4/2011 James et al.
2011/0147014 A1 6/2011 Chen et al.
2012/0018143 A1 1/2012 Lembcke
2012/0048531 A1 3/2012 Marzouk
2012/0048561 A1 3/2012 Holderman
2012/0048623 A1 3/2012 Lafuente et al.
2012/0049462 A1 3/2012 Pitman
2012/0168147 A1 7/2012 Bowersock
2012/0175134 A1 7/2012 Robisson
2012/0273236 A1 11/2012 Gandikota et al.
2013/0048289 A1 2/2013 Mazyar et al.
2013/0056207 A1 3/2013 Wood et al.
2013/0081815 A1 4/2013 Mazyar et al.
2013/0152824 A1 6/2013 Crews
2013/0153236 A1 6/2013 Bishop
2013/0161006 A1 6/2013 Robisson et al.
2013/0186615 A1 7/2013 Hallunbaek et al.
2013/0192853 A1 8/2013 Themig
2013/0292117 A1 11/2013 Robisson
2014/0026335 A1 1/2014 Smith

(56) References Cited

U.S. PATENT DOCUMENTS

2014/0034308 A1 2/2014 Holderman
2014/0051612 A1 2/2014 Mazyar
2014/0262352 A1 9/2014 Lembcke
2015/0021049 A1 1/2015 Davis et al.
2015/0075768 A1 3/2015 Wright et al.
2015/0101813 A1 4/2015 Zhao
2015/0113913 A1 4/2015 Kim
2015/0184486 A1 7/2015 Epstein
2015/0233190 A1 8/2015 Wolf et al.
2015/0275587 A1 10/2015 Wolf et al.
2015/0337615 A1 11/2015 Epstein et al.
2015/0345248 A1 12/2015 Carragher
2015/0368990 A1 12/2015 Jewett
2015/0369003 A1 12/2015 Hajjari et al.
2016/0002998 A1* 1/2016 Wang ..... E21B 33/1208 166/382
2016/0024896 A1 1/2016 Johnson et al.
2016/0024902 A1 1/2016 Richter
2016/0137912 A1 5/2016 Sherman et al.
2016/0138359 A1* 5/2016 Zhao ..... F16J 15/068 277/316
2016/0145488 A1 5/2016 Aines et al.
2016/0145968 A1 5/2016 Marya
2016/0177668 A1 6/2016 Watson et al.
2016/0194936 A1 7/2016 Allen
2016/0208569 A1 7/2016 Anderson et al.
2016/0230495 A1 8/2016 Mazyar et al.
2016/0273312 A1 9/2016 Steele et al.
2016/0319633 A1 11/2016 Cooper et al.
2016/0326830 A1 11/2016 Hallundbaek
2016/0326849 A1 11/2016 Bruce
2016/0333187 A1 11/2016 Bauer et al.
2017/0015824 A1* 1/2017 Gozalo ..... C08L 33/18
2017/0022778 A1 1/2017 Fripp et al.
2017/0107419 A1 4/2017 Roy et al.
2017/0107794 A1 4/2017 Steele
2017/0113275 A1 4/2017 Roy et al.
2017/0159401 A1 6/2017 Saltel et al.
2017/0175487 A1 6/2017 Marcin et al.
2017/0175488 A1 6/2017 Lisowski
2017/0191342 A1 7/2017 Turley
2017/0198191 A1 7/2017 Potapenko
2017/0234103 A1 8/2017 Frazier
2017/0306714 A1 10/2017 Haugland
2017/0314372 A1 11/2017 Tolman
2017/0350237 A1 12/2017 Giem et al.
2017/0356266 A1 12/2017 Arackakudiyil
2018/0023362 A1 1/2018 Makowiecki et al.
2018/0023366 A1 1/2018 Deng et al.
2018/0038193 A1 2/2018 Walton
2018/0080304 A1 3/2018 Cortez et al.
2018/0081468 A1 3/2018 Bruce et al.
2018/0086894 A1 3/2018 Roy
2018/0087350 A1* 3/2018 Sherman ..... E21B 43/086
2018/0094508 A1 4/2018 Smith et al.
2018/0100367 A1 4/2018 Perez
2018/0128072 A1 5/2018 Larsen
2018/0128082 A1 5/2018 Hollan et al.
2018/0209234 A1 7/2018 Manera
2018/0223624 A1 8/2018 Fripp
2018/0298708 A1 10/2018 Schmidt et al.
2018/0334882 A1 11/2018 Brandsdal
2018/0347288 A1 12/2018 Fripp
2018/0363409 A1 12/2018 Frazier
2019/0016951 A1 1/2019 Sherman et al.
2019/0032435 A1 1/2019 Kochanek et al.
2019/0039126 A1 2/2019 Sherman
2019/0078414 A1 3/2019 Frazier
2019/0128092 A1 5/2019 Mueller et al.
2019/0136666 A1 5/2019 Kent
2019/0178054 A1 6/2019 Bruce
2019/0186228 A1 6/2019 Beckett et al.
2019/0225861 A1 7/2019 Reddy
2019/0249510 A1 8/2019 Deng et al.
2019/0316025 A1 10/2019 Sherman
2019/0383115 A1 12/2019 Lees
2020/0032574 A1 1/2020 Fripp et al.
2020/0056435 A1 2/2020 Sherman
2020/0072019 A1 3/2020 Onti et al.
2020/0080401 A1 3/2020 Sherman
2020/0080402 A1 3/2020 Lang et al.
2020/0240235 A1 7/2020 Fripp et al.
2020/0308945 A1 10/2020 Surjaatmadja et al.
2020/0325749 A1 10/2020 Fripp et al.
2020/0362224 A1 11/2020 Wellhoefer
2020/0370391 A1 11/2020 Fripp et al.
2021/0017835 A1 1/2021 Pelto et al.
2021/0040810 A1 2/2021 Evers
2021/0115750 A1 4/2021 Fripp et al.
2021/0123310 A1 4/2021 Fripp et al.
2021/0123319 A1 4/2021 Greci
2021/0172286 A1 6/2021 Barlow
2021/0187604 A1 6/2021 Sherman et al.
2021/0270093 A1 9/2021 Fripp
2021/0270103 A1 9/2021 Greci et al.
2021/0332673 A1 10/2021 Fripp
2021/0363849 A1 11/2021 Al Yahya
2022/0106847 A1 4/2022 Dahl
2022/0186575 A1 6/2022 Fripp
2022/0205336 A1 6/2022 Asthana
2022/0372837 A1 11/2022 Holderman et al.

FOREIGN PATENT DOCUMENTS

CN 205422632 U 8/2016
CN 107148444 A 9/2017
CN 108194756 A 6/2018
CN 107148444 B 1/2019
CN 108194756 B 8/2020
EP 15726 A1 9/1980
EP 869257 A2 10/1998
EP 940558 A1 9/1999
EP 0940558 B1 1/2005
EP 1757770 A1 2/2007
EP 1910728 A1 4/2008
EP 1910728 B1 9/2009
EP 2096255 A1 9/2009
EP 2447466 A2 5/2012
EP 2501890 A2 9/2012
EP 2501890 B 7/2014
EP 2447466 A3 3/2017
EP 3144018 A1 3/2017
EP 3144018 A4 5/2017
EP 3196402 A1 7/2017
EP 3144018 B1 9/2018
EP 2447466 B1 10/2018
GB 2444060 A 5/2008
GB 2444060 B 12/2008
JP 2003090037 A 3/2003
JP 2003293354 A 10/2003
JP 2004169303 A 6/2004
JP 2015175449 A 10/2015
KR 20020014619 A 2/2002
KR 20080096576 A 10/2008
WO 02/02900 A2 1/2002
WO 02/02900 A3 5/2002
WO 02/02900 A8 12/2003
WO 2005/022012 A1 3/2005
WO 2006/045794 A1 5/2006
WO 2007/047089 A1 4/2007
WO 2009073531 A1 6/2009
WO 2012/094322 A2 7/2012
WO 2012/125660 A2 9/2012
WO 2012/094322 A3 10/2012
WO 2012/125660 A3 2/2013
WO 2014/028149 A1 2/2014
WO 2014/182301 A1 11/2014
WO 2014/193042 A1 12/2014
WO 2015/057338 A1 4/2015
WO 2015/069886 A2 5/2015
WO 2015/069886 A3 9/2015
WO 2015/183277 A1 12/2015
WO 2016/000068 A1 1/2016
WO 2016/171666 A1 10/2016

(56) References Cited

FOREIGN PATENT DOCUMENTS

| | | | | | |
|---|---|---|---|---|---|
| WO | 2016171665 | A1 | | 10/2016 | |
| WO | 2017/100417 | A1 | | 6/2017 | |
| WO | 2018/055382 | A1 | | 3/2018 | |
| WO | 2019/094044 | A1 | | 5/2019 | |
| WO | 2019/122857 | A1 | | 6/2019 | |
| WO | 2019/147285 | A1 | | 8/2019 | |
| WO | 2019/151870 | A1 | | 8/2019 | |
| WO | 2019/164499 | A1 | | 8/2019 | |
| WO | WO-2020005252 | A1 | * | 1/2020 | ..... C09K 8/5083 |
| WO | 2020068037 | A1 | | 4/2020 | |
| WO | 2020/141203 | A1 | | 7/2020 | |
| WO | 2019/164499 | A8 | | 8/2020 | |
| WO | 2020/167288 | A1 | | 8/2020 | |
| WO | 2020171825 | A1 | | 8/2020 | |
| WO | 2020/204940 | A1 | | 10/2020 | |
| WO | 2021010989 | A1 | | 1/2021 | |
| WO | 2021011013 | A1 | | 1/2021 | |
| WO | 2021/034325 | A1 | | 2/2021 | |
| WO | 2021076141 | A1 | | 4/2021 | |
| WO | 2021/086317 | A1 | | 5/2021 | |
| WO | 2021/096519 | A1 | | 5/2021 | |
| WO | 2021086351 | A1 | | 5/2021 | |
| WO | 2021/126279 | A1 | | 6/2021 | |

* cited by examiner

INDIVIDUAL SEPARATE CHUNKS OF EXPANDABLE METAL

BACKGROUND

Sealing and anchoring devices, among other related devices, are commonplace in oil and gas applications. Unfortunately, today's sealing and anchoring devices are limited by the materials that they comprise, and the conditions in which they are being set. Specifically, the material chosen, and downhole conditions often limit how quickly today's sealing and anchoring devices may be set.

BRIEF DESCRIPTION

Reference is now made to the following descriptions taken in conjunction with the accompanying drawings, in which.

DETAILED DESCRIPTION

Figure 1:
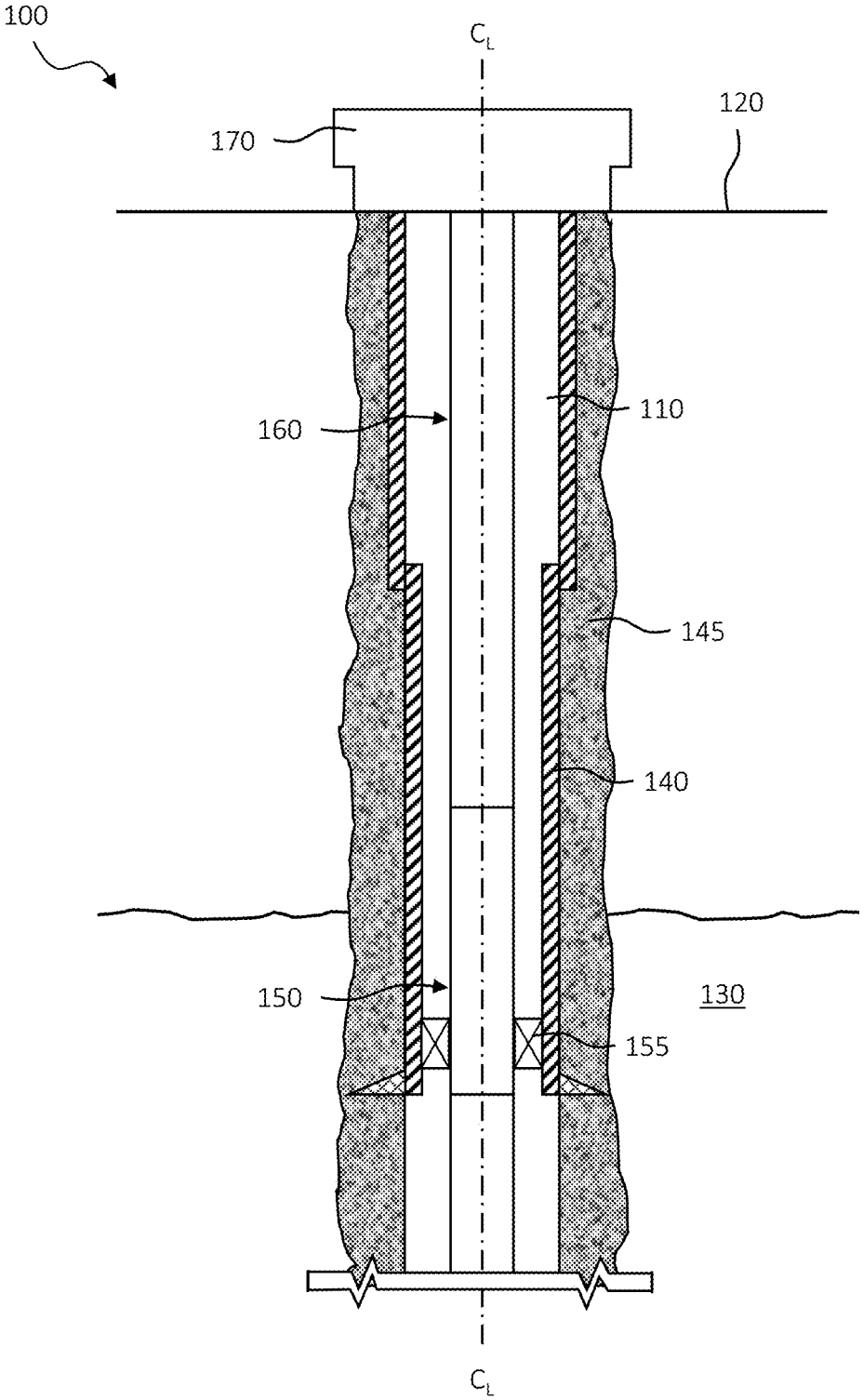
FIG. 1 illustrates a well system designed, manufactured, and operated according to one or more embodiments of the disclosure, the well system including a downhole tool designed, manufactured, and operated according to one or more embodiments of the disclosure.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described. Unless otherwise specified, use of the terms "up," "upper," "upward," "uphole," "upstream," or other like terms shall be construed as generally toward the surface of the ground; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

The present disclosure has acknowledged that today's sealing and/or anchoring devices, particularly those using conventional elastomeric materials, have certain drawbacks. Specifically, the present disclosure has acknowledged that the high temperature limits, low temperature sealing limits, swabbing while running issues, extrusion over time issues, and inability to conform to irregular shapes, among other issues associated with conventional elastomeric sealing and/or anchoring devices, make said sealing and/or anchoring devices less than desirable in certain applications. The present disclosure, based upon these acknowledgments, has thus recognized that sealing and/or anchoring devices employing expandable/expanded metal address many of the concerns related to the sealing and/or anchoring devices using conventional elastomeric materials.

The present disclosure has further recognized that it is important for the expandable/expandable metal sealing and/or anchoring devices to set quickly, for example to compete with traditional hydraulic and/or mechanically actuated sealing and/or anchoring devices. The present disclosure has recognized that the expandable metal only reacts on exposed surfaces, and thus by increasing the surface area, the chemical reaction needed for setting the expandable/expanded metal sealing and/or anchoring devices may be greatly increased. Accordingly, the present disclosure details many ways to increase the surface area of the exposed expandable metal.

FIG. 1 illustrates a well system 100 designed, manufactured, and operated according to one or more embodiments of the disclosure, the well system 100 including a downhole tool 150 designed, manufactured and operated according to one or more embodiments of the disclosure. The downhole tool 150, in at least one embodiment, is a sealing and/or anchoring tool, and thus may include one or more sealing elements 155. The terms "sealing tool" and "sealing element," as used herein, are intended to include both tools and elements that seal two surfaces together, as well as tools and elements that anchor two surfaces together.

The well system 100 includes a wellbore 110 that extends from a terranean surface 120 into one or more subterranean zones 130. When completed, the well system 100 may be configured to produce reservoir fluids and/or inject fluids into the subterranean zones 130. As those skilled in the art appreciate, the wellbore 120 may be fully cased, partially cased, or an open hole wellbore. In the illustrated embodiment of FIG. 1, the wellbore 110 is at least partially cased, and thus is lined with casing or liner 140. The casing or liner 140, as is depicted, may be held into place by cement 145.

An example downhole tool 150, in one or more embodiments, is coupled with a conveyance 160 that extends from a wellhead 170 into the wellbore 110. The conveyance 160 can be a coiled tubing and/or a string of joint tubing coupled end to end, among others, and remain within the scope of the disclosure. For example, the conveyance 160 may be a working string, an injection string, and/or a production string. In at least one embodiment, the downhole tool 150 can include a bridge plug, frac plug, packer and/or other sealing tool, having one or more sealing elements 155 for sealing against the wellbore 110 wall (e.g., the casing 140, a liner and/or the bare rock in an open hole context). The one or more sealing elements 155 can isolate an interval of the wellbore 110 above the one or more sealing elements 155, from an interval of the wellbore 110 below the one or more sealing elements 155, for example, so that a pressure differential can exist between the intervals.

In accordance with one embodiment of the disclosure, the downhole tool 150 may include a tubular (e.g., mandrel, base pipe, etc.), as well as one or more expandable metal seal elements placed about the tubular, the one or more expandable metal seal elements comprising a metal configured to expand in response to hydrolysis and having a surface-area-to-volume ratio (SA:V) of at least 2 $cm^{-1}$. In accordance with another embodiment of the disclosure, the downhole tool 150 may include a tubular, as well as a collection of individual separate chunks of expandable metal positioned about the tubular, the collection of individual separate chunks of expandable metal comprising a metal configured to expand in response to hydrolysis.

What results are one or more expanded metal seal elements extending between two surfaces. The term expandable metal, as used herein, refers to the expandable metal in a pre-expansion form. Similarly, the term expanded metal, as used herein, refers to the resulting expanded metal after the expandable metal has been subjected to reactive fluid, as discussed below. The expanded metal, in accordance with one or more aspects of the disclosure, comprises a metal that has expanded in response to hydrolysis. In certain embodiments, the expanded metal includes residual unreacted metal. For example, in certain embodiments the expanded metal is intentionally designed to include the residual unreacted metal. The residual unreacted metal has the benefit of allowing the expanded metal to self-heal if cracks or other anomalies subsequently arise, or for example to accommodate changes in the tubular or mandrel diameter due to variations in temperature and/or pressure. Nevertheless, other embodiments may exist wherein no residual unreacted metal exists in the expanded metal.

The expandable metal, in some embodiments, may be described as expanding to a cement like material. In other words, the expandable metal goes from metal to micron-scale particles and then these particles expand and lock together to, in essence, seal two or more surfaces together. The reaction may, in certain embodiments, occur in less than 2 days in a reactive fluid and in downhole temperatures. Nevertheless, the time of reaction may vary depending on the reactive fluid, the expandable metal used, the downhole temperature, and as discussed in great detail herein, the surface-area-to-volume ratio (SA:V) of the expandable metal.

In some embodiments, the reactive fluid may be a brine solution such as may be produced during well completion activities, and in other embodiments, the reactive fluid may be one of the additional solutions discussed herein. The expandable metal is electrically conductive in certain embodiments. The expandable metal may be machined to any specific size/shape, extruded, formed, cast or other conventional ways to get the desired shape of a metal, as will be discussed in greater detail below. In at least some embodiments, the expandable metal is a collection of individual separate chunks of expandable metal. The expandable metal, in certain embodiments has a yield strength greater than about 8,000 psi, e.g., 8,000 psi+/−50%.

The hydrolysis of the expandable metal can create a metal hydroxide. The formative properties of alkaline earth metals (Mg—Magnesium, Ca—Calcium, etc.) and transition metals (Zn—Zinc, Al—Aluminum, etc.) under hydrolysis reactions demonstrate structural characteristics that are favorable for use with the present disclosure. Hydration results in an increase in size from the hydration reaction and results in a metal hydroxide that can precipitate from the fluid.

The hydration reactions for magnesium is:

$$Mg+2H_2O \rightarrow Mg(OH)_2+H_2,$$

where $Mg(OH)_2$ is also known as brucite. Another hydration reaction uses aluminum hydrolysis. The reaction forms a material known as Gibbsite, bayerite, boehmite, aluminum oxide, and norstrandite, depending on form. The possible hydration reactions for aluminum are:

$$Al+3H_2O \rightarrow Al(OH)_3+3/2H_2.$$

$$Al+2H_2O \rightarrow AlO(OH)+3/2H_2$$

$$Al+3/2H_2O \rightarrow \tfrac{1}{2}Al_2O_3+3/2H_2$$

Another hydration reaction uses calcium hydrolysis. The hydration reaction for calcium is:

$$Ca+2H_2O \rightarrow Ca(OH)_2+H_2,$$

Where $Ca(OH)_2$ is known as portlandite and is a common hydrolysis product of Portland cement. Magnesium hydroxide and calcium hydroxide are considered to be relatively insoluble in water. Aluminum hydroxide can be considered an amphoteric hydroxide, which has solubility in strong acids or in strong bases. Alkaline earth metals (e.g., Mg, Ca, etc.) work well for the expandable metal, but transition metals (Al, etc.) also work well for the expandable metal. In one embodiment, the metal hydroxide is dehydrated by the swell pressure to form a metal oxide.

In an embodiment, the expandable metal used can be a metal alloy. The expandable metal alloy can be an alloy of the base expandable metal with other elements in order to either adjust the strength of the expandable metal alloy, to adjust the reaction time of the expandable metal alloy, or to adjust the strength of the resulting metal hydroxide byproduct, among other adjustments. The expandable metal alloy can be alloyed with elements that enhance the strength of the metal such as, but not limited to, Al—Aluminum, Zn—Zinc, Mn—Manganese, Zr—Zirconium, Y—Yttrium, Nd—Neodymium, Gd—Gadolinium, Ag—Silver, Ca—Calcium, Sn—Tin, and Re—Rhenium, Cu—Copper. In some embodiments, the expandable metal alloy can be alloyed with a dopant that promotes corrosion, such as Ni—Nickel, Fe—Iron, Cu—Copper, Co—Cobalt, Ir—Iridium, Au—Gold, C—Carbon, Ga—Gallium, In—Indium, Mg—Mercury, Bi—Bismuth, Sn—Tin, and Pd—Palladium. The expandable metal alloy can be constructed in a solid solution process where the elements are combined with molten metal or metal alloy. Alternatively, the expandable metal alloy could be constructed with a powder metallurgy process. The expandable metal can be cast, forged, extruded, sintered, welded, mill machined, lathe machined, stamped, eroded or a combination thereof. The metal alloy can be a mixture of the metal and metal oxide. For example, a powder mixture of aluminum and aluminum oxide can be ball-milled together to increase the reaction rate.

Optionally, non-expanding components may be added to the starting metallic materials. For example, ceramic, elastomer, plastic, epoxy, glass, or non-reacting metal components can be embedded in the expandable metal or coated on the surface of the expandable metal. In yet other embodiments, the non-expanding components are metal fibers, a composite weave, a polymer ribbon, or ceramic granules, among others. Alternatively, the starting expandable metal may be the metal oxide. For example, calcium oxide (CaO) with water will produce calcium hydroxide in an energetic reaction. Due to the higher density of calcium oxide, this can have a 260% volumetric expansion (e.g., converting 1 mole of CaO may cause the volume to increase from 9.5 cc to 34.4 cc). In one variation, the expandable metal is formed in a serpentinite reaction, a hydration and metamorphic reaction. In one variation, the resultant material resembles a mafic material. Additional ions can be added to the reaction, including silicate, sulfate, aluminate, carbonate, and phosphate. The metal can be alloyed to increase the reactivity or to control the formation of oxides.

The expandable metal can be configured in many different fashions, as long as an adequate volume of material is available for fully expanding. For example, the expandable metal may be formed into a single long member, multiple short members, rings, among others. In another embodiment, the expandable metal may be formed into a long wire of expandable metal, that can be in turn be wound around a downhole feature such as a tubular. The wire diameters do not need to be of circular cross-section, but may be of any cross-section. For example, the cross-section of the wire could be oval, rectangle, star, hexagon, keystone, hollow braided, woven, twisted, among others, and remain within the scope of the disclosure. In certain other embodiments, the expandable metal is a collection of individual separate chunks of the metal held together with a binding agent. In yet other embodiments, the expandable metal is a collection of individual separate chunks of the metal that are not held together with a binding agent. Additionally, a delay coating may be applied to one or more portions of the expandable metal to delay the expanding reactions.

In at least one other embodiment, voids may exist between adjacent portions of the expandable metal. In at least one embodiment, the voids may be at least partially filled with a material configured to delay the hydrolysis process. In one embodiment, the material configured to delay the hydrolysis process is a fusible alloy. In another embodiment, the material configured to delay the hydrolysis process is a eutectic material. In yet another embodiment, the material configured to delay the hydrolysis process is a wax, oil, or other non-reactive material. Alternatively, the voids may be at least partially filled with a material configured to expedite the hydrolysis process. In one embodiment, the material configured to expedite the hydrolysis process is a reactive powder, such as salt.

Figure 2A:
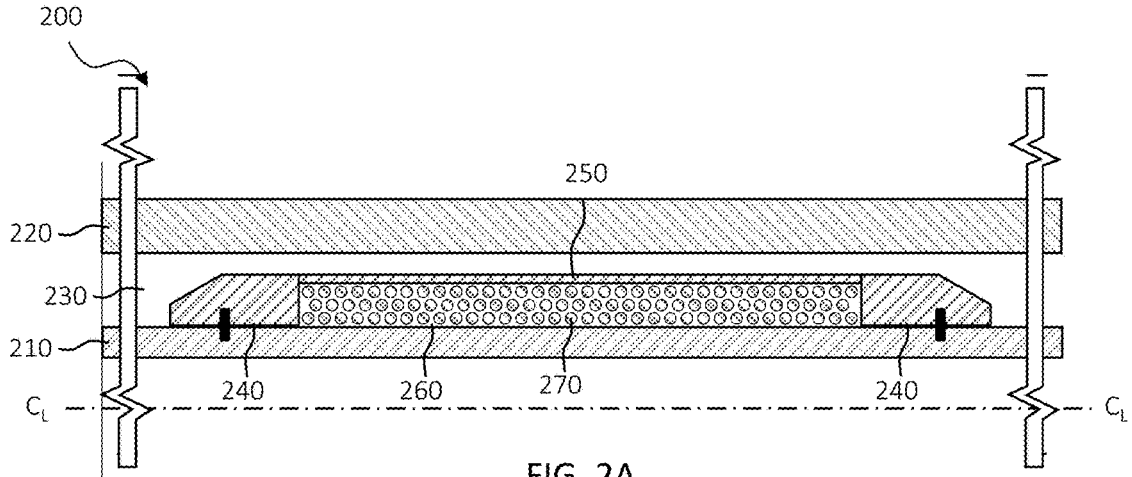
FIGS. 2A through 2C illustrate different deployment states for a downhole tool designed, manufactured, and operated according to one aspect of the disclosure.
Figure 2B:
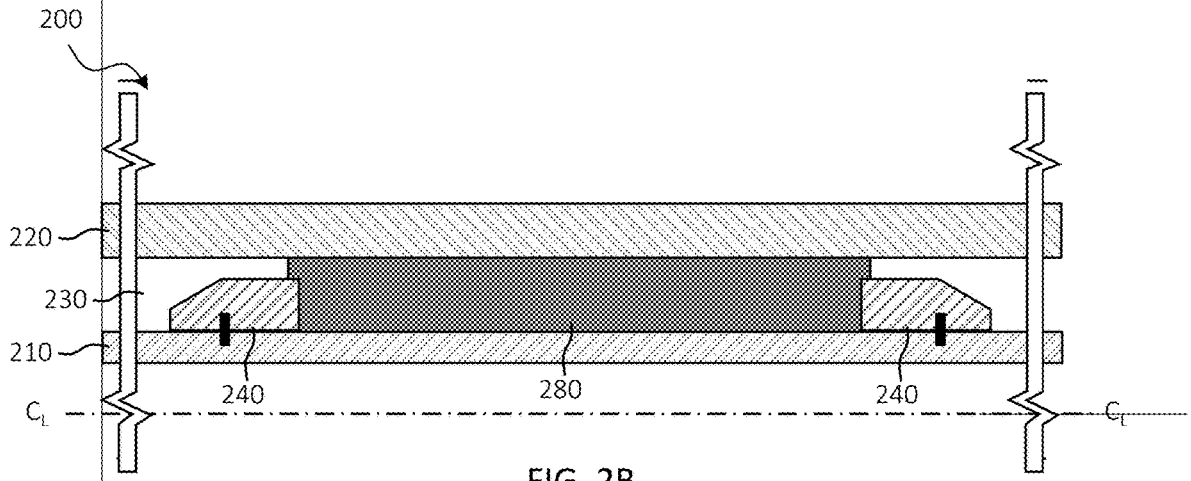
Figure 2C:
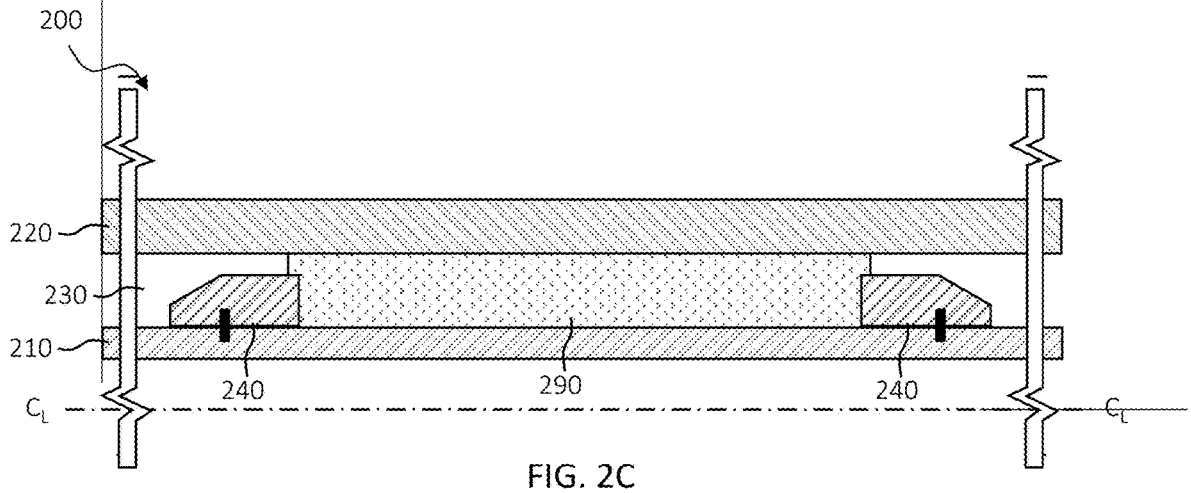

Turning now to FIGS. 2A through 2C, illustrated are different deployment states for a downhole tool 200 designed, manufactured, and operated according to one aspect of the disclosure. FIG. 2A illustrates the downhole tool 200 pre-expansion, FIG. 2B illustrates the downhole tool 200 post-expansion, and FIG. 2C illustrates the downhole tool 200 post-expansion and containing residual unreacted expandable metal therein. As disclosed above, the expandable metal of FIG. 2A may be subjected to a suitable reactive fluid within a wellbore, thereby forming the expanded metal shown in FIGS. 2B and 2C.

The downhole tool 200, in the illustrated embodiment of FIGS. 2A through 2C, includes a tubular 210. The tubular 210 may comprise any surface that exists within a wellbore while remaining within the scope of the disclosure. The tubular 210, in the illustrated embodiment, is centered about a centerline (CO. The downhole tool 200, in at least the embodiment of FIGS. 2A through 2C, additionally includes a surface 220 positioned about the tubular 210. In at least one embodiment, the surface 220 is a tubular, such as for example casing, production tubing, etc. In yet another embodiment, the surface 220 is the wellbore itself, for example if an open-hole wellbore is being used. In accordance with one aspect of the disclosure, the tubular 210 and the surface 220 form a first space 230 there between. In at least one embodiment, the first space 230 is an annulus between the tubular 210 and the surface 220, the annulus extending around the centerline (CO. In yet other embodiments, the first space 230 does not extend entirely around the centerline (CO, and thus does not form an annulus.

The downhole tool 200, in at least the embodiment of FIGS. 2A through 2C, additionally includes a pair of end rings 240 positioned between the tubular 210 and the surface 220, and within the first space 230. The downhole tool 200, in one or more embodiments, also includes a sleeve 250 spanning the pair of end rings 240. As is evident in the embodiment of FIGS. 2A through 2C, the pair of end rings 240 and the sleeve 250 define a second space 260. In one or more embodiments, the sleeve 250 is a solid sleeve. In yet another embodiment, not shown, the sleeve 250 includes one or more openings therein for allowing reactive fluid to enter the second space 260. In yet another embodiment, the sleeve 250 is a screen or wire mesh.

In at least one embodiment, the pair of end rings 240 and/or the sleeve 250 may comprise a metal configured to expand in response to hydrolysis. In the illustrated embodiment of FIGS. 2A through 2C, the pair of end rings 240 comprise a non-expandable metal, but the sleeve 250 comprises an expandable metal. Other embodiments, however, exist wherein the sleeve 250 comprises a non-expandable metal and the pair of endplates 240 comprise an expandable metal. Yet other embodiments exist wherein neither the pair of end rings 240 nor the sleeve 250 comprise an expandable metal, or yet other embodiments exist wherein both the pair of end rings 240 and the sleeve 250 comprise an expandable metal.

With reference to FIG. 2A, one or more expandable metal seal elements 270 may be placed about the tubular 210, the one or more expandable metal seal elements 270 comprising a metal configured to expand in response to hydrolysis. The one or more expandable metal seal elements 270 may comprise any of the expandable metals discussed above. Further to the embodiment of FIG. 2A, the one or more expandable metal seal elements 270 may have a surface-area-to-volume ratio (SA:V) of at least 2 $cm^{-1}$. In another embodiment, the one or more expandable metal seal elements 270 may have a surface-area-to-volume ratio (SA:V) of at least 5 $cm^{-1}$. In yet another embodiment, the one or more expandable metal seal elements 270 may have a surface-area-to-volume ratio (SA:V) of less than 100 $cm^{-1}$, and in other embodiments a surface-area-to-volume ratio (SA:V) ranging from 5 $cm^{-1}$ to 50 $cm^{-1}$, or alternatively a surface-area-to-volume ratio (SA:V) ranging from 10 $cm^{-1}$ to 20 $cm^{-1}$. The specific surface-area-to-volume ratio (SA:V) of the one or more expandable metal seal elements 270 may be chosen based upon a desired reaction time for the one or more expandable metal seal elements 270. As discussed above, the higher the surface-area-to-volume ratio (SA:V) (e.g., for a given material), the faster the reaction rate will be (e.g., for that same material).

In the embodiment of FIG. 2A, the one or more expandable metal seal elements 270 are one or more wires of expandable metal wrapped (e.g., helically wrapped) around the tubular 210. In the illustrated embodiment, the one or more wires of expandable metal are positioned within the second space 260 between the pair of end rings 240 and the sleeve 250. In the embodiment of FIG. 2A, a single wire of expandable metal is wrapped multiple times around the tubular 210, as well as back over and on top of itself. Thus, in the embodiment of FIG. 2A, three layers of the single wire of expandable metal exist around the tubular 210. Other configurations, however, are within the scope of the disclosure. Moreover, while the wire of expandable metal illustrated in FIG. 2A includes a circular cross-section, other embodiments exist wherein the cross-section of the wire could be oval, rectangle, star, hexagon, keystone, hollow braided, woven, twisted, among others, and remain within the scope of the disclosure. Furthermore, the one or more wires of expandable metal may be heat treated to reduce spring back. In at least one embodiment, the one or more expandable metal seal elements 270 are swaged down to the tubular 210 to prevent voids. In other embodiments, voids are intentionally left or created.

With reference to FIG. 2B, illustrated is the downhole tool 200 of FIG. 2A after subjecting the one or more expandable metal seal elements 270 to reactive fluid, thereby forming one or more expanded metal seal elements 280, as discussed above. In the illustrated embodiment, the one or more expandable metal seal elements 270 turn into a single expanded metal seal element 280 when substantially reacted. Nevertheless, other embodiments exist wherein the one or more expandable metal seal elements 270 turn into multiple expanded metal seal elements 280 when substantially reacted. Again, the one or more expanded metal seal elements 280 may function as a seal, an anchor, or both a seal and an anchor and remain within the scope of the disclosure.

In certain embodiments, the time period for the hydration of the one or more expandable metal seal elements 270 is different from the time period for the hydration of one or both of the pair of end rings 240 and/or sleeve 250. For example, the greater surface-area-to-volume ratio (SA:V) of the one or more expandable metal seal elements 270, as compared to the lesser surface-area-to-volume ratio (SA:V) of the pair of end rings 240 and/or sleeve 250, may cause the one or more expandable metal seal elements 270 to expand in response to hydrolysis faster than the pair of end rings 240 and/or sleeve 250. In addition, or alternatively, the one or more expandable metal seal elements 270 might comprise an expandable metal material that reacts faster than the expandable metal material of the pair of end rings 240 and/or sleeve 250.

With reference to FIG. 2C, illustrated is the downhole tool 200 illustrated in FIG. 2A after subjecting the one or more expandable metal seal elements 270 to reactive fluid to form one or more expanded metal seal elements including residual unreacted expandable metal therein 290, as discussed above. In one embodiment, the one or more expanded metal seal elements including residual unreacted expandable metal therein 290 include at least 1% residual unreacted expandable metal therein. In yet another embodiment, the one or more expanded metal seal elements including residual unreacted expandable metal therein 290 include at least 3% residual unreacted expandable metal therein. In even yet another embodiment, the one or more expanded metal seal elements including residual unreacted expandable metal therein 290 include at least 10% residual unreacted expandable metal therein, and in certain embodiments at least 20% residual unreacted expandable metal therein.

Figure 3A:
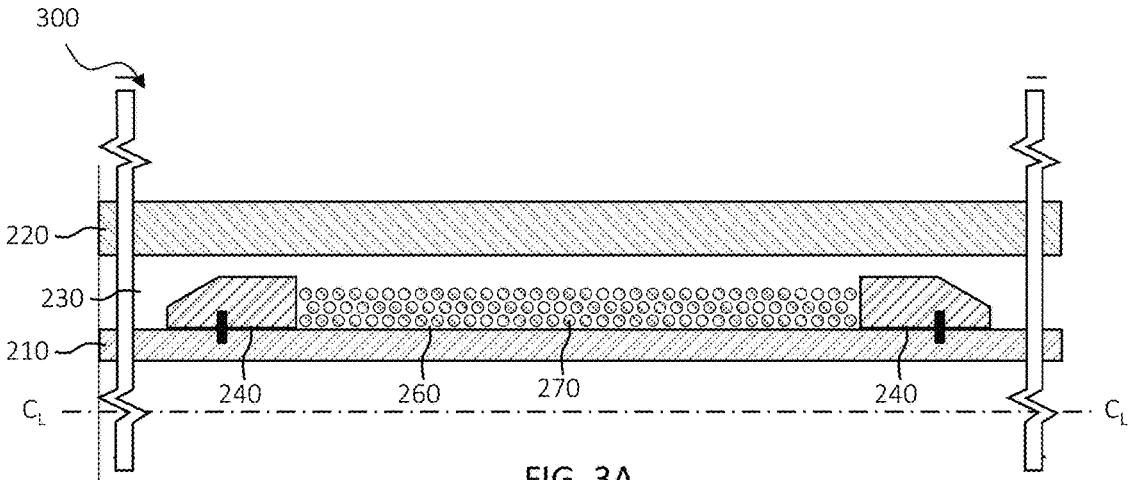
FIGS. 3A through 3C illustrate different deployment states for a downhole tool designed, manufactured, and operated according to one aspect of the disclosure.
Figure 3B:
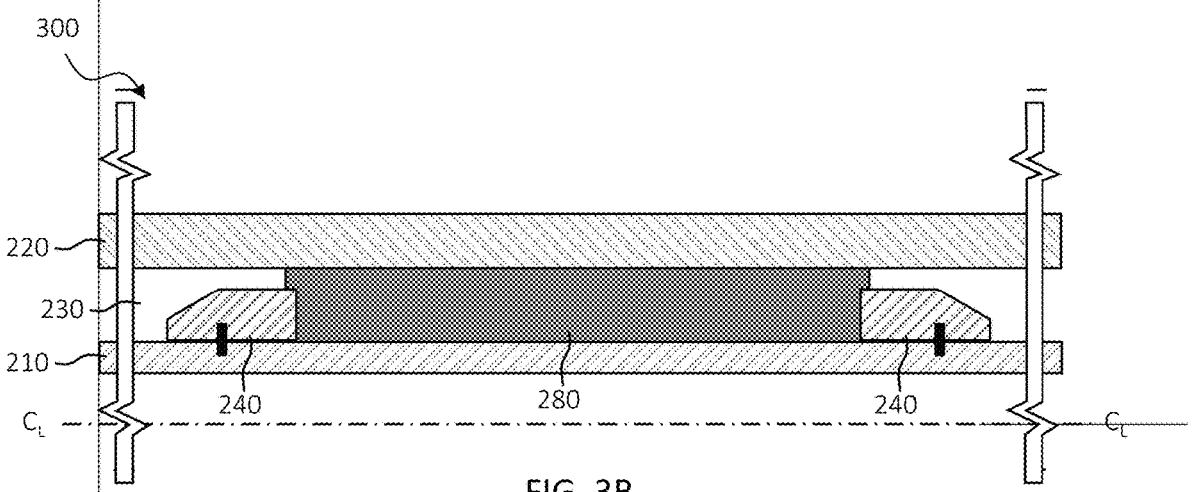
Figure 3C:
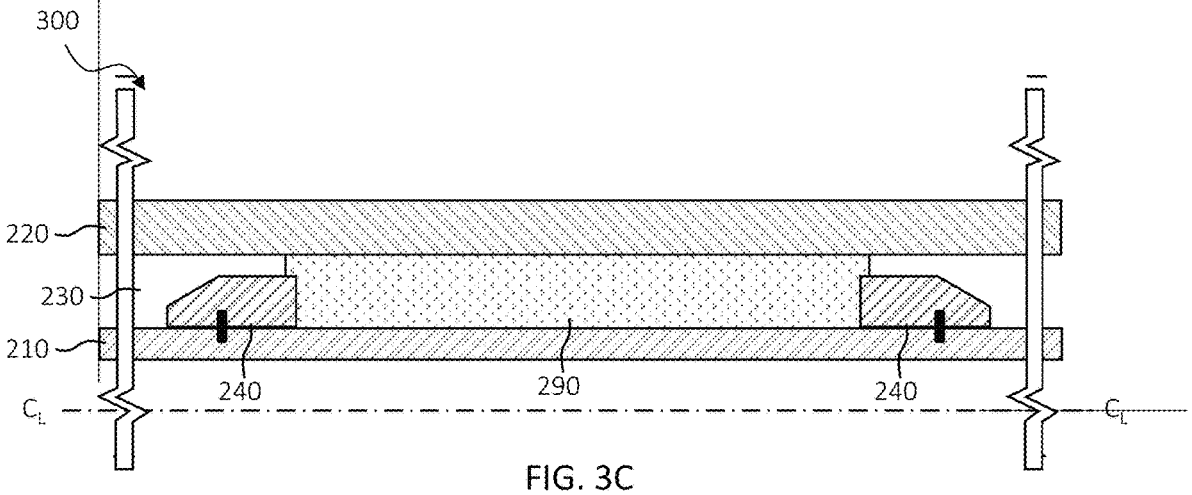

Turning now to FIGS. 3A through 3C, depicted are various different manufacturing states for a downhole tool 300 designed, manufactured, and operated according to an alternative embodiment of the disclosure. FIG. 3A illustrates the downhole tool 300 pre-expansion, FIG. 3B illustrates the downhole tool 300 post-expansion, and FIG. 3C illustrates the downhole tool 300 post-expansion and containing residual unreacted expandable metal therein. The downhole tool 300 of FIGS. 3A through 3C is similar in many respects to the downhole tool 200 of FIGS. 2A through 2C. Accordingly, like reference numbers have been used to illustrate similar, if not identical, features. The downhole tool 300 differs, for the most part, from the downhole tool 200, in that the downhole tool 300 does not employ the sleeve 250.

Figure 4A:
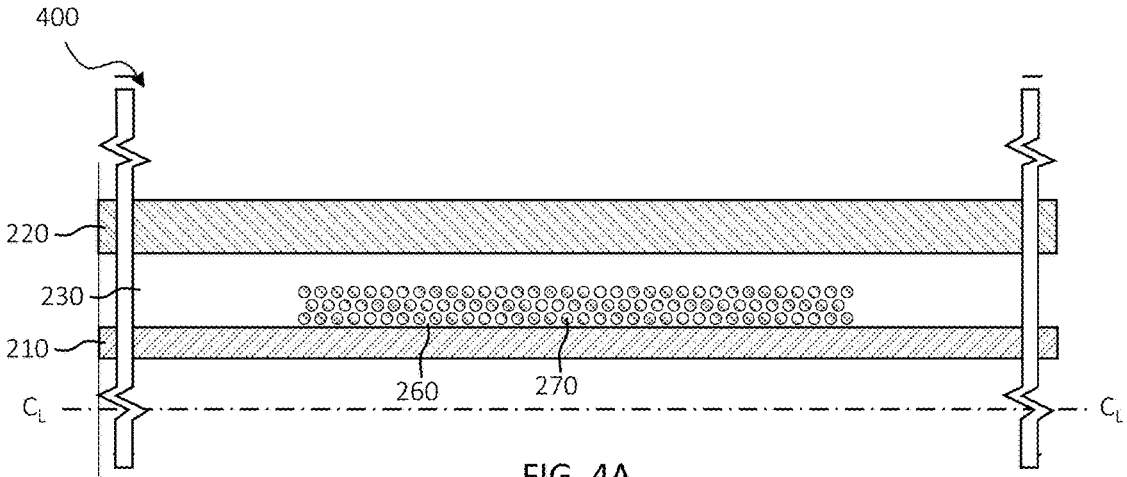
FIGS. 4A through 4C illustrate different deployment states for a downhole tool designed, manufactured, and operated according to one aspect of the disclosure.
Figure 4B:
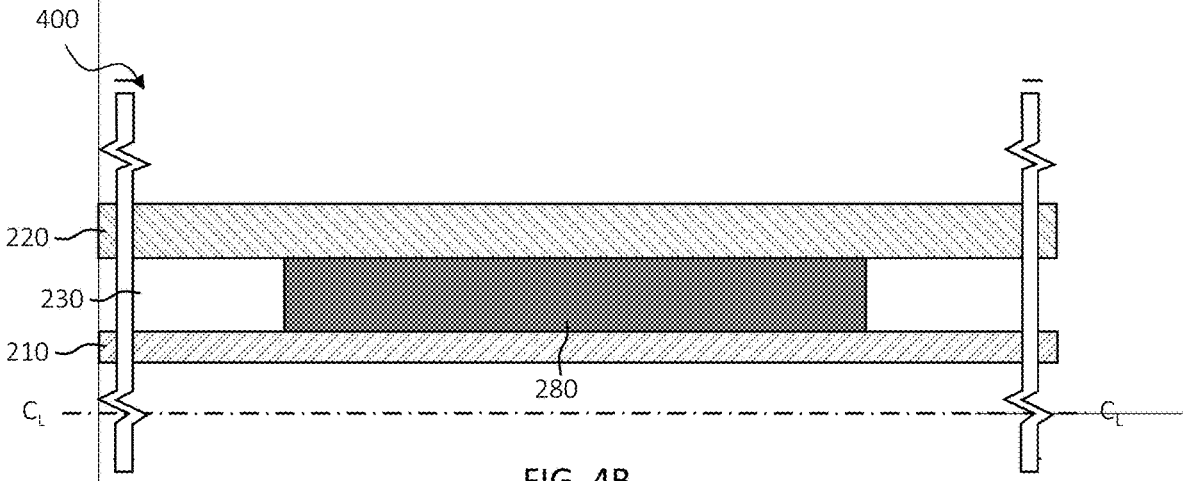
Figure 4C:
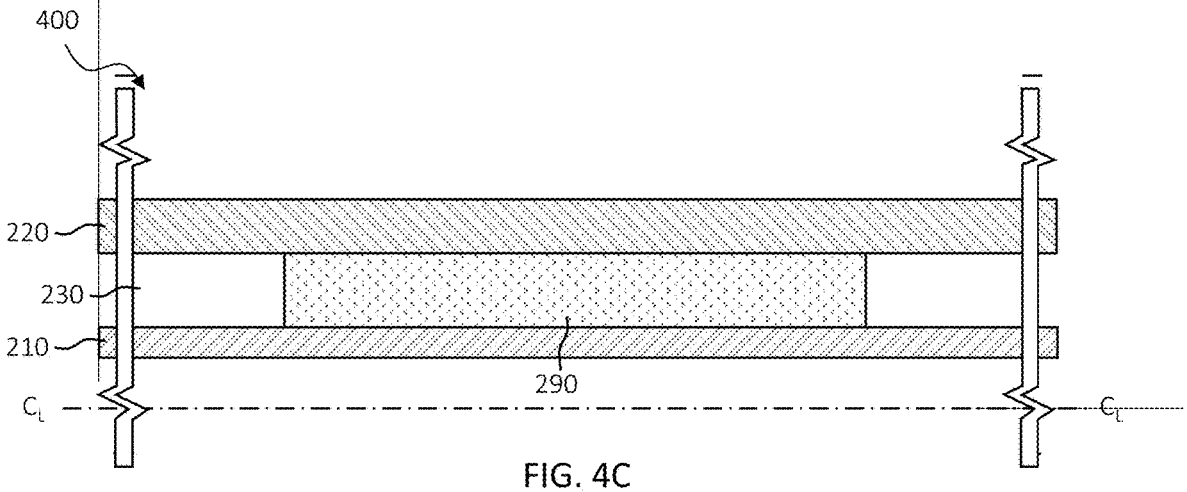

Turning now to FIGS. 4A through 4C, depicted are various different manufacturing states for a downhole tool 400 designed, manufactured and operated according to an alternative embodiment of the disclosure. FIG. 4A illustrates the downhole tool 400 pre-expansion, FIG. 4B illustrates the downhole tool 400 post-expansion, and FIG. 4C illustrates the downhole tool 400 post-expansion and containing residual unreacted expandable metal therein. The downhole tool 400 of FIGS. 4A through 4C is similar in many respects to the downhole tool 200 of FIGS. 2A through 2C. Accordingly, like reference numbers have been used to illustrate similar, if not identical, features. The downhole tool 400 differs, for the most part, from the downhole tool 200, in that the downhole tool 400 does not employ the pair of end rings 240 or the sleeve 250. Thus, in accordance with this embodiment, the one or more expandable metal seal elements 270 are individually placed within the first space 230.

Figure 5A:
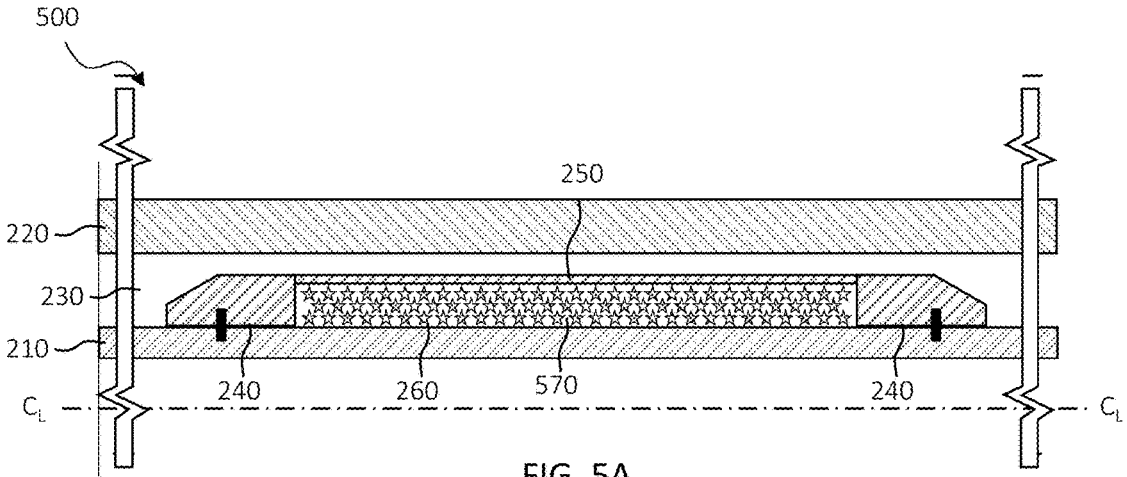
FIGS. 5A through 5C illustrate different deployment states for a downhole tool designed, manufactured, and operated according to one aspect of the disclosure.
Figure 5B:
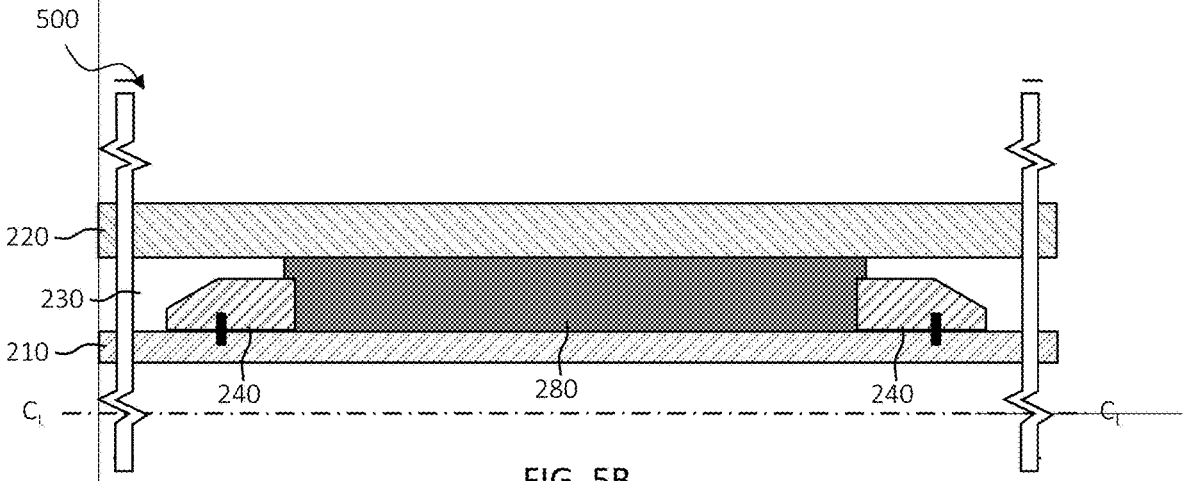
Figure 5C:
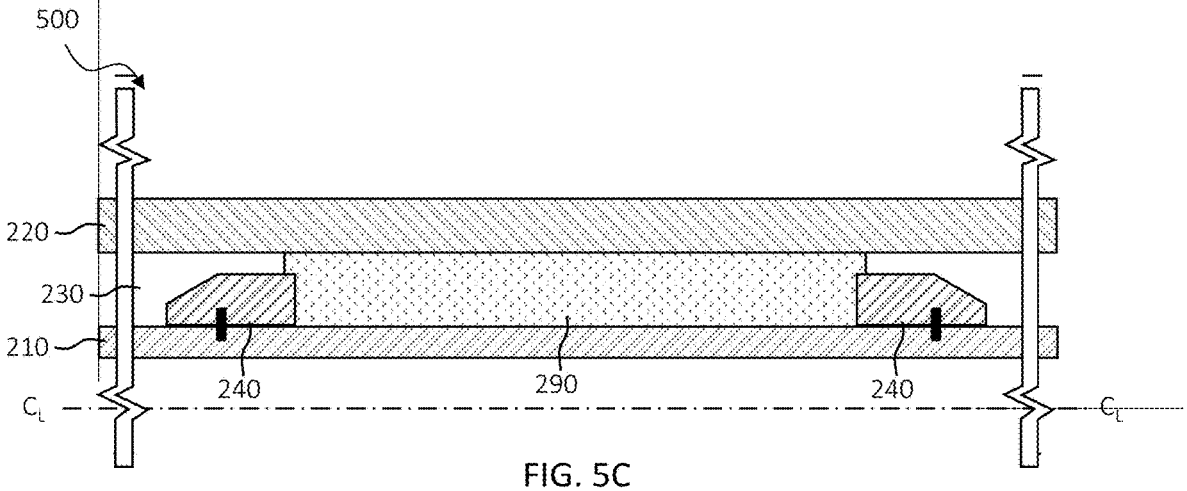

Turning now to FIGS. 5A through 5C, depicted are various different manufacturing states for a downhole tool 500 designed, manufactured and operated according to an alternative embodiment of the disclosure. FIG. 5A illustrates the downhole tool 500 pre-expansion, FIG. 5B illustrates the downhole tool 500 post-expansion, and FIG. 5C illustrates the downhole tool 500 post-expansion and containing residual unreacted expandable metal therein. The downhole tool 500 of FIGS. 5A through 5C is similar in many respects to the downhole tool 200 of FIGS. 2A through 2C. Accordingly, like reference numbers have been used to illustrate similar, if not identical, features. The downhole tool 500 differs, for the most part, from the downhole tool 200, in that the downhole tool 500 employs a non-circular cross-section for its one or more expandable metal seal elements 570. Specifically, in the embodiment of FIGS. 5A through 5C, the one or more expandable metal seal elements 570 have a star shaped cross-section, among other possible shapes.

Figure 6A:
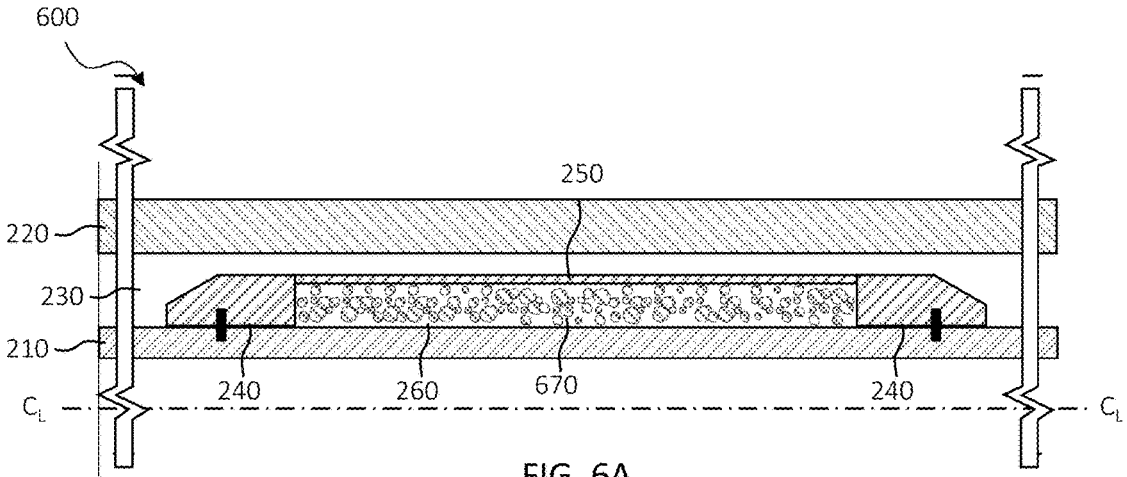
FIGS. 6A through 6C illustrate different deployment states for a downhole tool designed, manufactured, and operated according to one aspect of the disclosure.
Figure 6B:
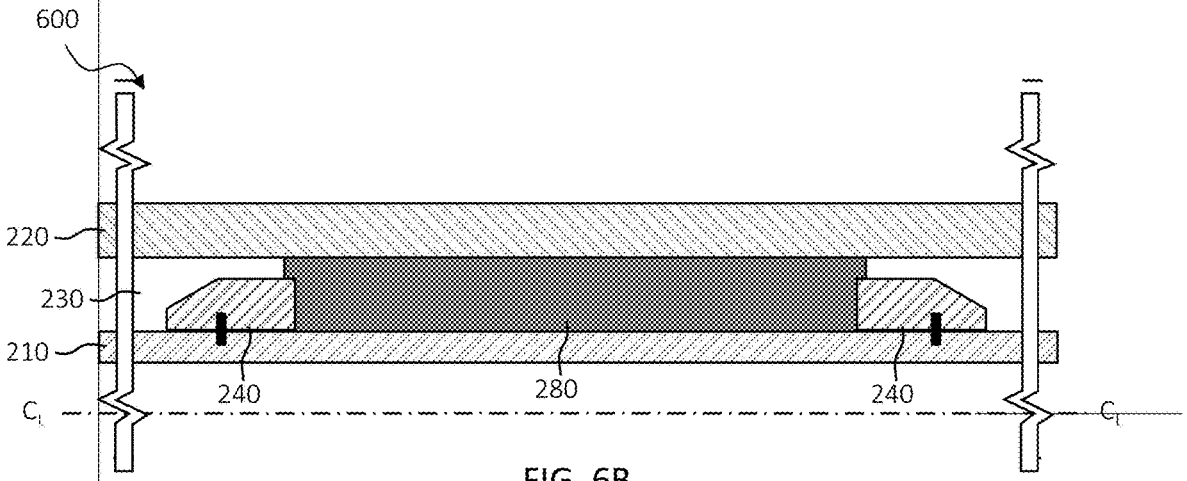
Figure 6C:
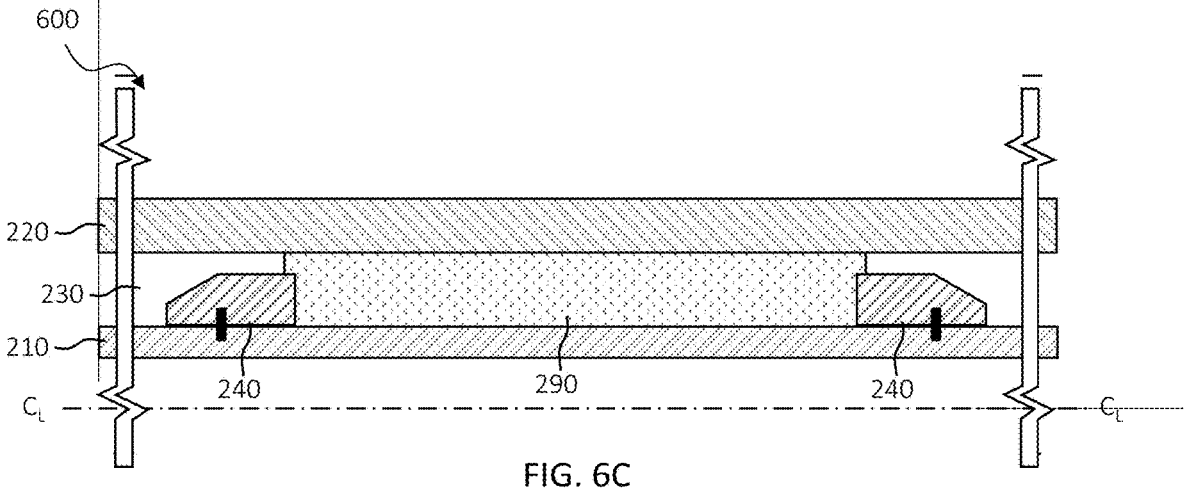

Turning now to FIGS. 6A through 6C, depicted are various different manufacturing states for a downhole tool 600 designed, manufactured and operated according to an alternative embodiment of the disclosure. FIG. 6A illustrates the downhole tool 600 pre-expansion, FIG. 6B illustrates the downhole tool 600 post-expansion, and FIG. 6C illustrates the downhole tool 600 post-expansion and containing residual unreacted expandable metal therein. The downhole tool 600 of FIGS. 6A through 6C is similar in many respects to the downhole tool 200 of FIGS. 2A through 2C. Accordingly, like reference numbers have been used to illustrate similar, if not identical, features. The downhole tool 600 differs, for the most part, from the downhole tool 200, in that the downhole tool 600 employs a collection of individual separate chunks of expandable metal 670 positioned about the tubular 210. In one embodiment, the collection of individual separate chunks of expandable metal 670 have a surface-area-to-volume ratio (SA:V) of at least 2 $cm^{-1}$. In another embodiment, the collection of individual separate chunks of expandable metal 670 have a surface-area-to-volume ratio (SA:V) of at least 5 $cm^{-1}$. In yet another embodiment, the collection of individual separate chunks of expandable metal 670 have a surface-area-to-volume ratio (SA:V) of less than 100 $cm^{-1}$, or alternatively a surface-area-to-volume ratio (SA:V) ranging from 5 $cm^{-1}$ to 50 $cm^{-1}$.

In certain embodiments, the collection of individual separate chunks of the expandable metal 670 are a collection of individual separate different sized chunks of expandable metal. For example, in certain embodiments, a first volume of a largest of the collection of individual separate chunks of the expandable metal 670 is at least 5 times a second volume of a smallest of the collection of individual separate chunks of the expandable metal 670. In another embodiment, a first volume of a largest of the collection of individual separate chunks of the expandable metal 670 is at least 50 times a second volume of a smallest of the collection of individual separate chunks of the expandable metal 670. Furthermore, while the embodiment of FIG. 6A employs different sized chunks of expandable metal 670, other embodiments exist wherein each of the chunks of expandable metal 670 are substantially (e.g., with 10%) the same. Moreover, in certain embodiments, the collection of individual separate chunks of expandable metal 670 may comprise two or more different expandable metals or an expandable metal and a metal oxide. In one embodiment, the chunks of expandable metal 670 are compressed together to form a loosely bound conglomeration of chunks.

In the embodiment of 6A, the collection of individual separate chunks of expandable metal 670 are positioned within the second space 260 and are held in place with the sleeve 250. In yet another embodiment, the individual separate chunks of expandable metal 670 are held in place with a screen, or mesh material. In other embodiments, one or more of the pairs of end rings 240 and/or the sleeve 250 are not necessary. For example, in certain embodiments, the collection of individual separate chunks of the expandable metal 670 are held together with a binding agent, which might not require the pairs of end rings 240 and/or the sleeve 250. In at least one embodiment, the binding agent is salt, which may also be used to expedite the hydrolysis reaction.

Figure 7A:
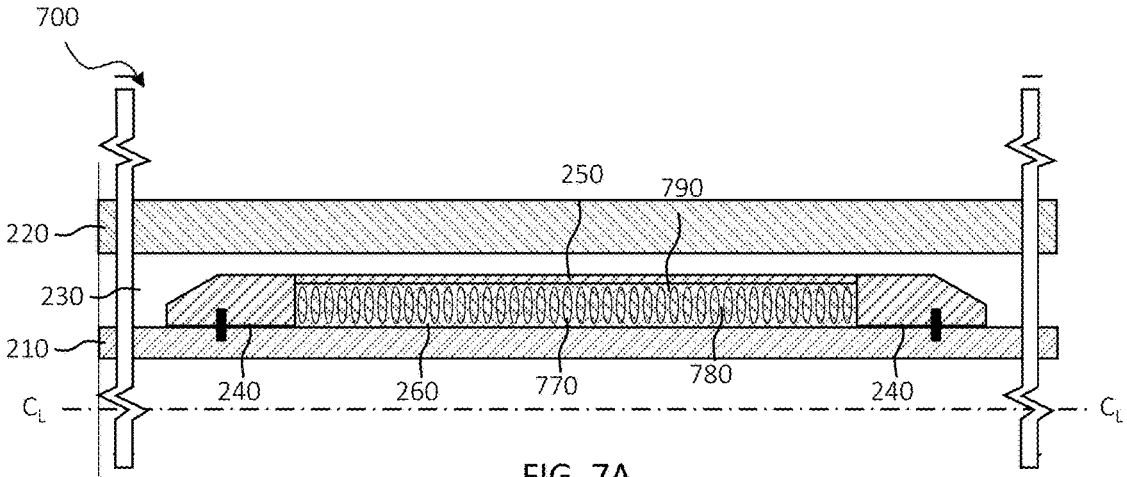
FIGS. 7A through 7C illustrate different deployment states for a downhole tool designed, manufactured, and operated according to one aspect of the disclosure.
Figure 7B:
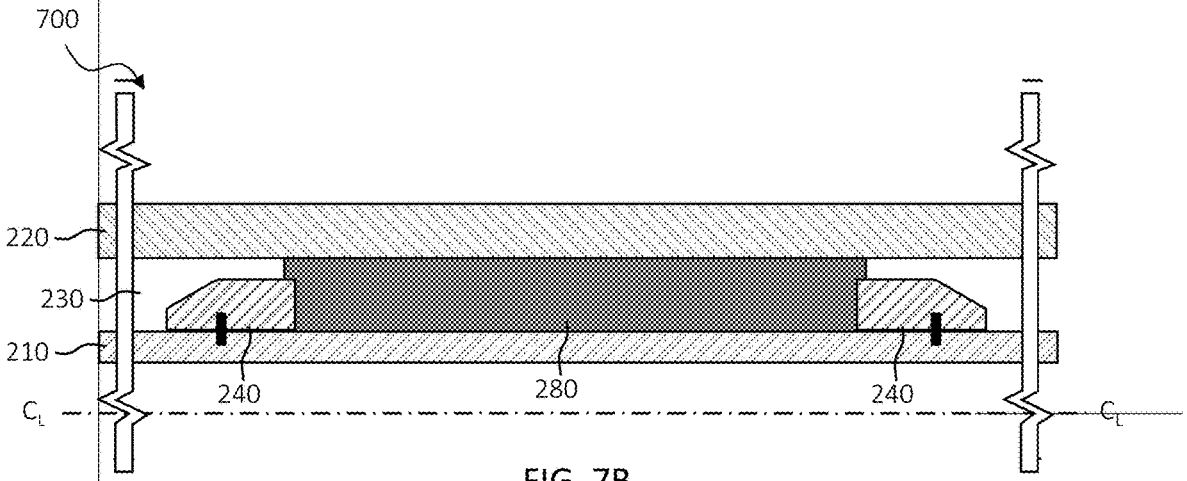
Figure 7C:
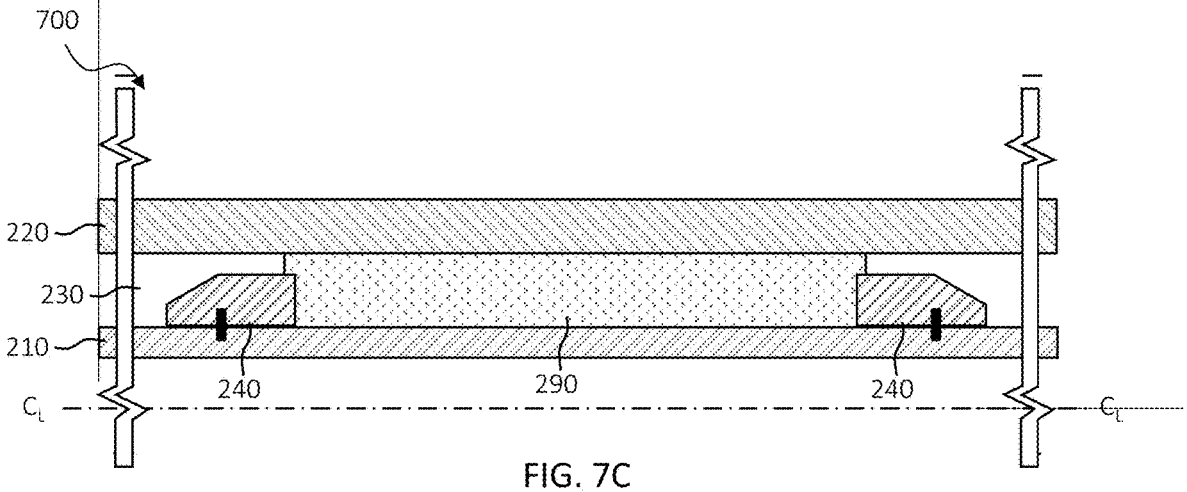

Turning now to FIGS. 7A through 7C, depicted are various different manufacturing states for a downhole tool 700 designed, manufactured and operated according to an alternative embodiment of the disclosure. FIG. 7A illustrates the downhole tool 700 pre-expansion, FIG. 7B illustrates the downhole tool 700 post-expansion, and FIG. 7C illustrates the downhole tool 700 post-expansion and containing residual unreacted expandable metal therein. The downhole tool 700 of FIGS. 7A through 7C is similar in many respects to the downhole tool 200 of FIGS. 2A through 2C. Accordingly, like reference numbers have been used to illustrate similar, if not identical, features. The downhole tool 700 differs, for the most part, from the downhole tool 200, in that the downhole tool 700 employs a plurality of axially stacked expandable metal seal elements 770.

In the embodiment of FIG. 7A, each of the plurality of axially stacked expandable metal seal elements 770 are separate features that may move relative to one another. Further to the embodiment of FIG. 7A, the plurality of axially stacked expandable metal seal elements 770 are configured such that voids 780 exist between adjacent portions of the plurality of axially stacked expandable metal seal elements 770. Further to the embodiment of FIG. 7A, a material 790 may at least partially fill the voids 780. In at least one embodiment, the material 790 is configured to delay the hydrolysis, such as with an oil or a wax. In yet another embodiment, the material 790 is configured to expedite the hydrolysis, such as with a salt or an acid anhydride. Furthermore, the plurality of axially stacked expandable metal seal elements 770 may have surface texture to aid fluid contact, including without limitation crenulations, divots, roughness, etc. Furthermore, certain embodiments may employ one or more polymer rings, such as elastomer rings, along with the axially stacked expandable metal seal elements 770. The polymer rings may be at the ends of the axially stacked expandable metal seal elements 770, or may be interspersed within the axially stacked expandable metal seal elements 770.

Figure 8A:
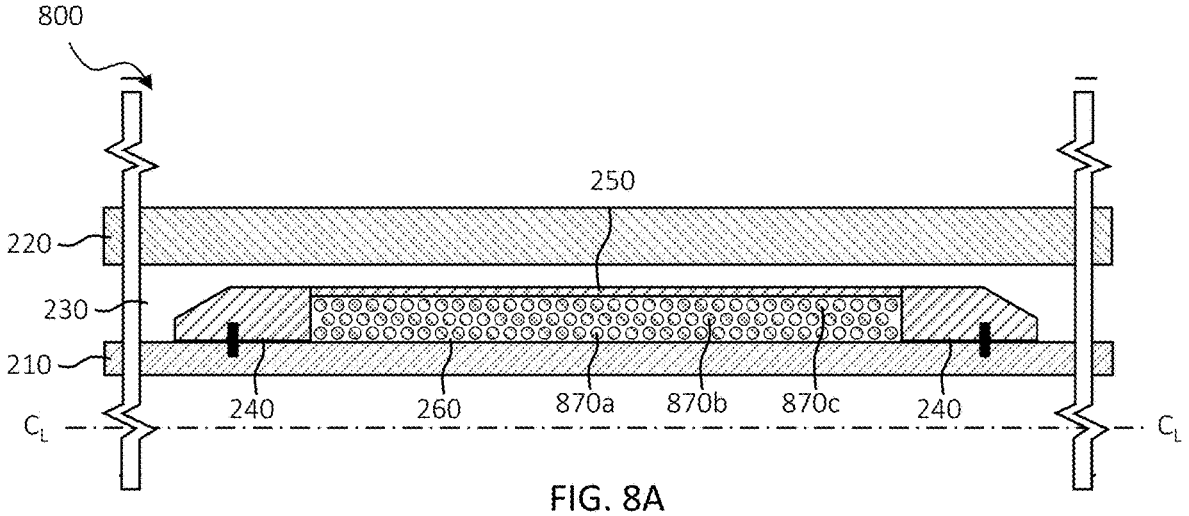
FIGS. 8A through 8E illustrate different deployment states for a downhole tool designed, manufactured, and operated according to one aspect of the disclosure.
Figure 8B:
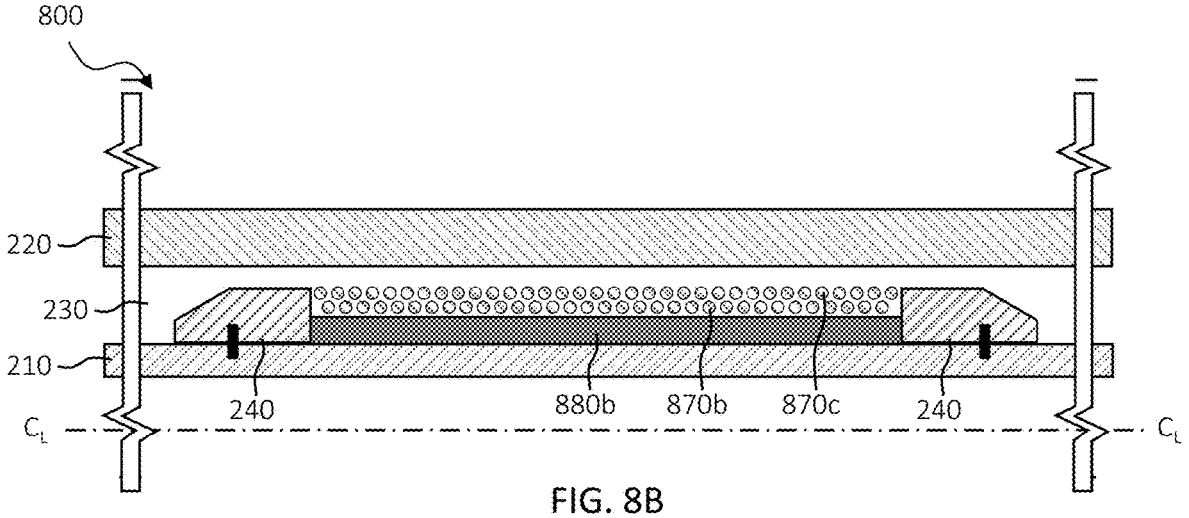
Figure 8C:
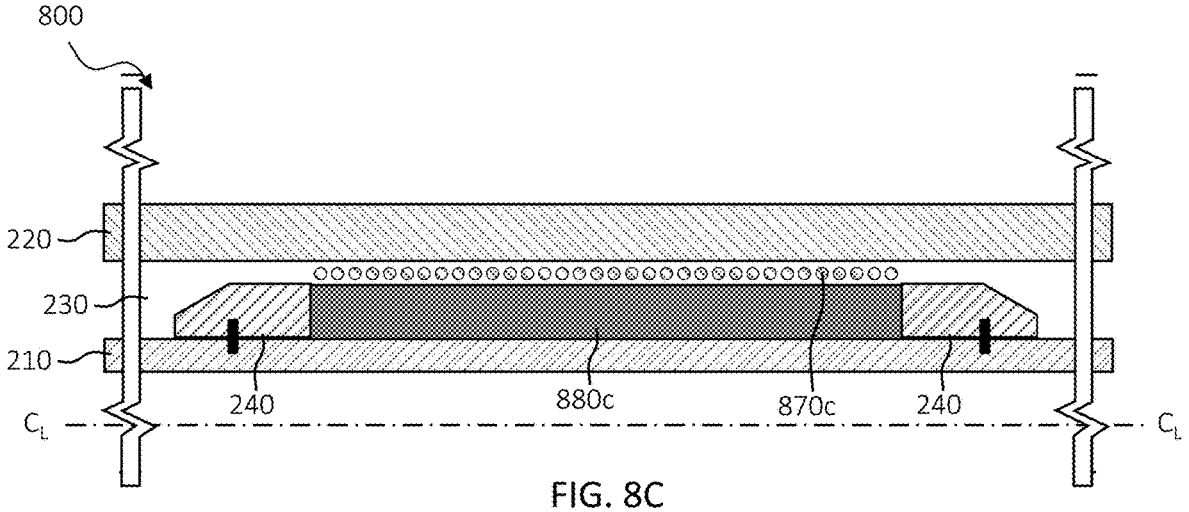
Figure 8D:
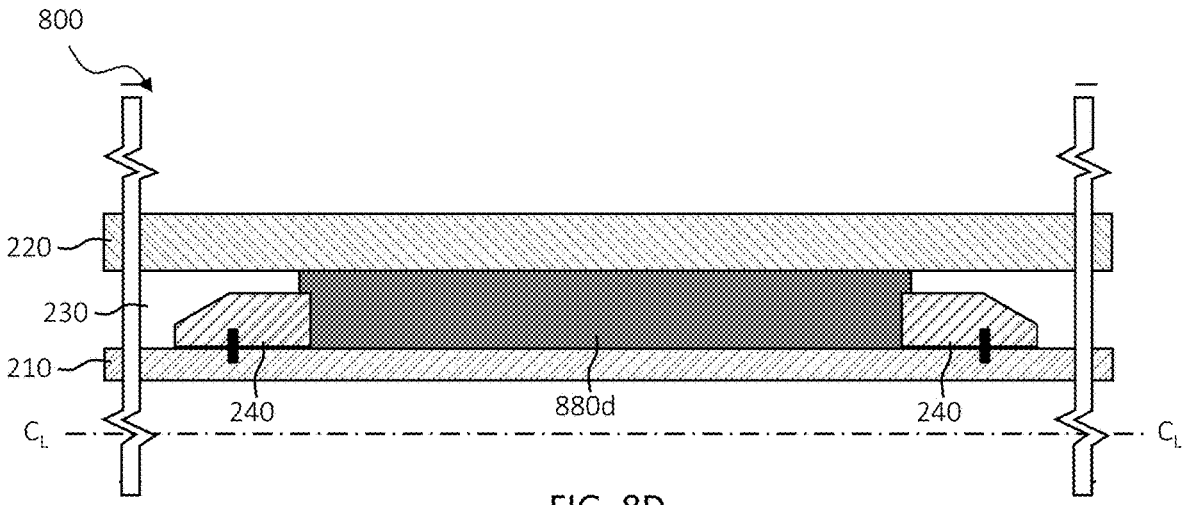
Figure 8E:
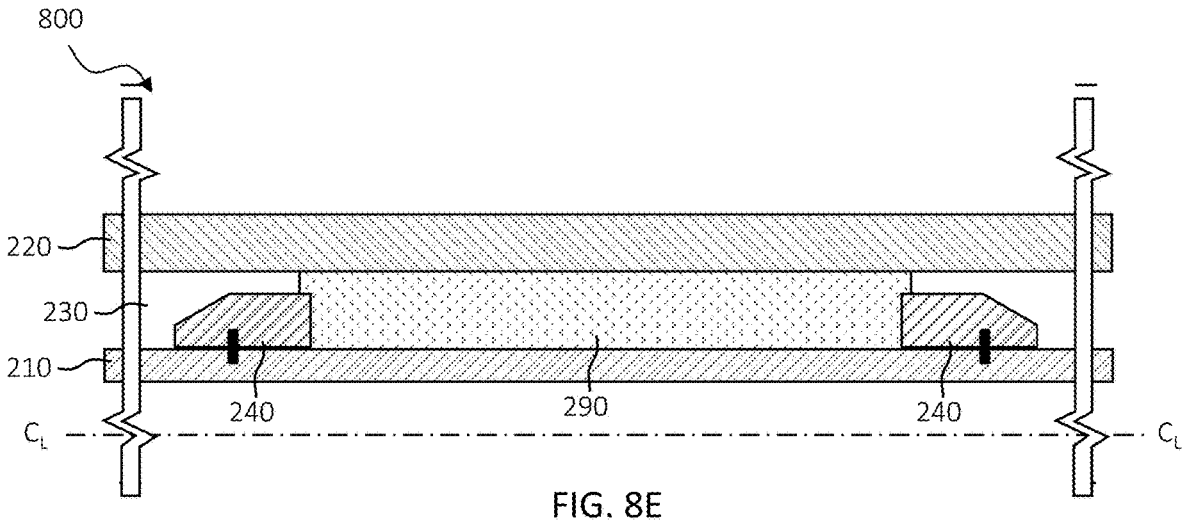

Turning now to FIGS. 8A through 8E, depicted are various different manufacturing states for a downhole tool 800 designed, manufactured and operated according to an alternative embodiment of the disclosure. FIG. 8A illustrates the downhole tool 800 pre-expansion, FIG. 8B illustrates the downhole tool 800 at an initial-stage of expansion, FIG. 8C illustrates the downhole tool 800 at a mid-stage of expansion, FIG. 8D illustrates the downhole tool 800 post-expansion, and FIG. 8E illustrates the downhole tool 800 post-expansion and containing residual unreacted expandable metal therein. The downhole tool 800 of FIGS. 8A through 8E is similar in many respects to the downhole tool 200 of FIGS. 2A through 2C. Accordingly, like reference numbers have been used to illustrate similar, if not identical, features. The downhole tool 800 differs, for the most part, from the downhole tool 200, in that the downhole tool 800 employs multiple separate wires of expandable metal.

For example, in the embodiment of FIG. 8A, the downhole tool 800 includes a first wire of expandable metal 870*a* wrapped around the tubular 210, a second different wire of expandable metal 870*b* wrapped around the first wire of expandable metal 870*a*, and a third different wire of expandable metal 870*c* wrapped around the second wire of expandable metal 870*b*. The first, second and third wires of expandable metal 870*a*, 870*b*, 870*c* may comprise the same or different materials, and may have the same or different reaction rates. Nevertheless, in the embodiment of FIGS. 8A through 8C, the first, second and third wires of expandable metal 870*a*, 870*b*, 870*c* have different reaction rates. Specific to the embodiment of FIGS. 8A through 8C, the first wire of expandable metal 870*a* has the fasted reaction rate, the second wire of expanded metal 870*b* has the second fasted reaction rate, and the third wire of expanded metal 870*c* has the slowest reaction rate. The opposite could be true, however, and remain within the scope of the disclosure.

In at least one embodiment, the differing reaction rates are a function of their differing surface-area-to-volume ratios (SA:V). Thus, in at least one embodiment, the first wire 870*a* has the largest surface-area-to-volume ratio (SA:V), the second different wire 870*b* has a second lesser surface-area-to-volume ratio (SA:V), and the third different wire 870*c* has a third lowest surface-area-to-volume ratio (SA:V). For example, in at least one embodiment, the first wire 870*a* has the surface-area-to-volume ratio (SA:V) of at least 10 $cm^{-1}$, the second different wire 870*b* has a second lesser surface-area-to-volume ratio (SA:V) between 5 $cm^{-1}$ and 10 $cm^{-1}$, and the third different wire 870*c* has a third lowest surface-area-to-volume ratio (SA:V) between 2 $cm^{1}$ and 5 $cm^{1}$.

In yet another embodiment, the differing reaction rates are a function of their differing materials. For example, a material for the first wire 870*a* could be chosen to have the fasted reaction rate, a material for the second wire 870*b* could be chosen to have the middle reaction rate, and a material for the third wire 870*c* could be chosen to have the slowest reaction rate. Nevertheless, the opposite could be true. As shown in FIGS. 8B through 8D, the expanded metal seal element 880*b*, 880*c*, 880*d* incrementally expands as each of the first, second and third wires of expandable metal 870*a*, 870*b*, 870*c* expand in response to hydrolysis.

Figure 9A:
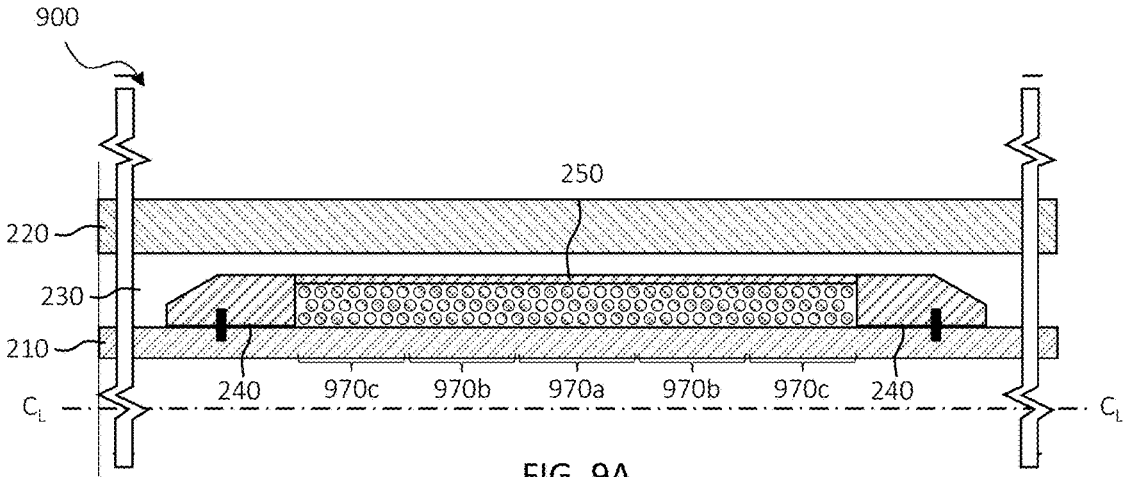
FIGS. 9A through 9E illustrate different deployment states for a downhole tool designed, manufactured, and operated according to one aspect of the disclosure.
Figure 9B:
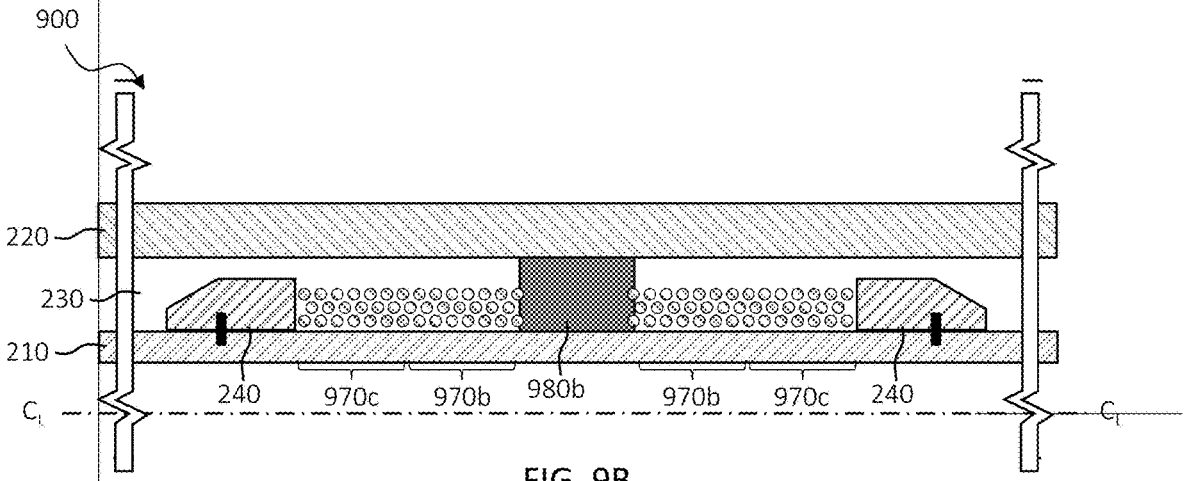
Figure 9C:
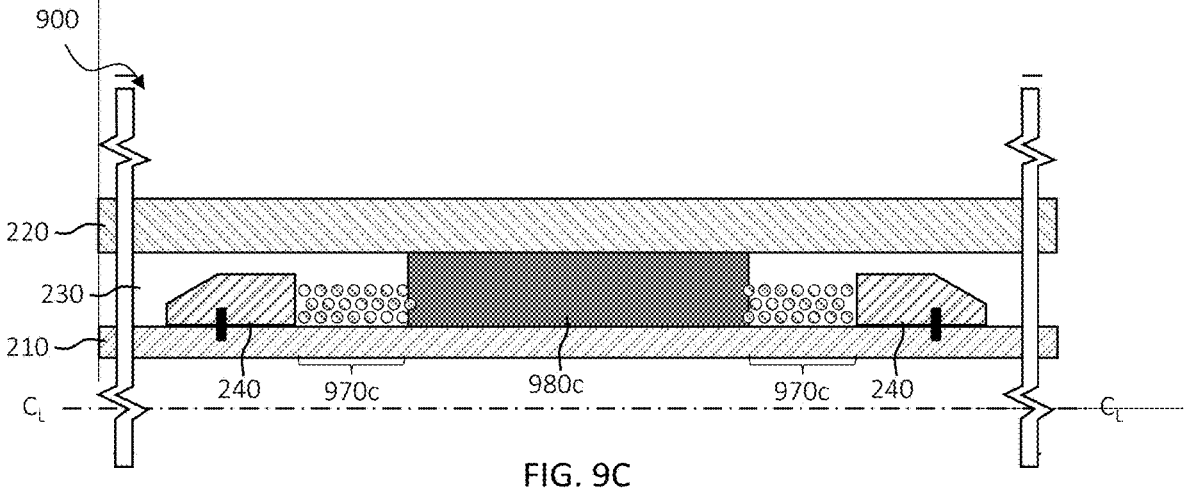
Figure 9D:
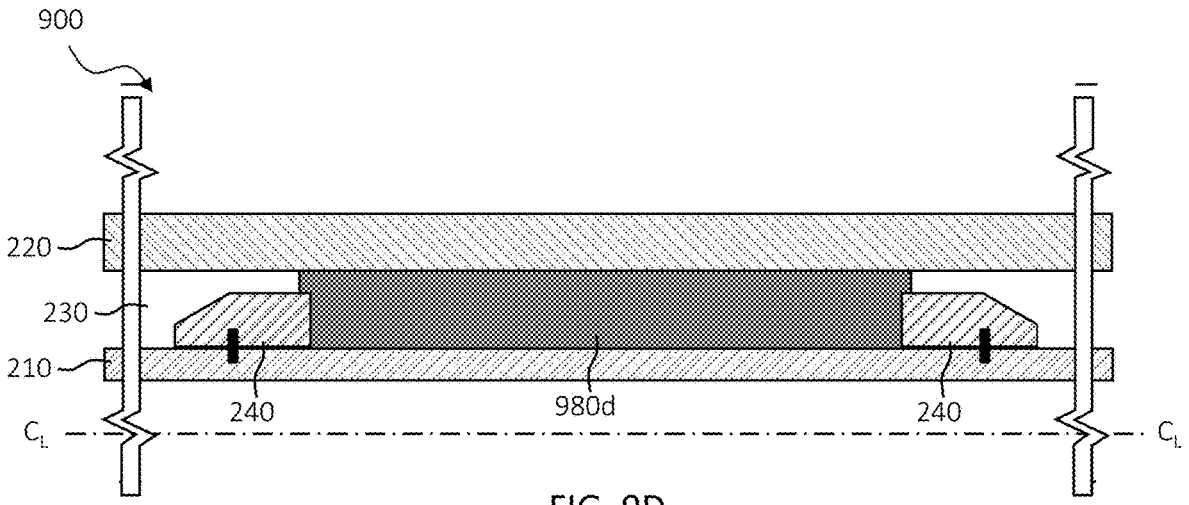
Figure 9E:
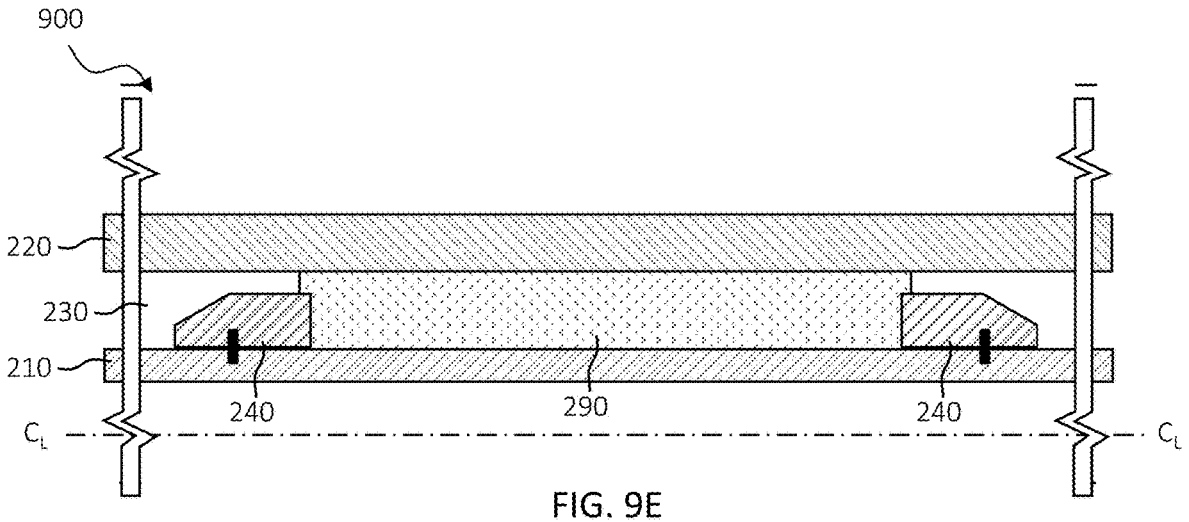

Turning now to FIGS. 9A through 9E, depicted are various different manufacturing states for a downhole tool 900 designed, manufactured and operated according to an alternative embodiment of the disclosure. FIG. 9A illustrates the downhole tool 900 pre-expansion, FIG. 9B illustrates the downhole tool 900 at an initial-stage of expansion, FIG. 9C illustrates the downhole tool 900 at a mid-stage of expansion, FIG. 9D illustrates the downhole tool 900 post-expansion, and FIG. 9E illustrates the downhole tool 900 post-expansion and containing residual unreacted expandable metal therein. The downhole tool 900 of FIGS. 9A through 9E is similar in many respects to the downhole tool 800 of FIGS. 8A through 8E. Accordingly, like reference numbers have been used to illustrate similar, if not identical, features. The downhole tool 900 differs, for the most part, from the downhole tool 800, in that the downhole tool 900 employs first, second and third wires of expandable metal 970*a*, 970*b*, 970*c* that are axially stacked relative to one another. Further to the embodiment of FIGS. 9A through 9E, the first wire of expandable metal 970*a* has the fastest reaction rate, the second wire of expanded metal 970*b* has the second fasted reaction rate, and the third wire of expandable metal 970*c* has the slowest reaction rate. Such is shown in FIGS. 9B through 9D with the expanded metal seal element 980*b*, 980*c*, 980*d* incrementally expanding as each of the first, second and third wires of expandable metal 970*a*, 970*b*, 970*c* expand in response to hydrolysis. Nevertheless, the opposite could be true.

Figure 10A:
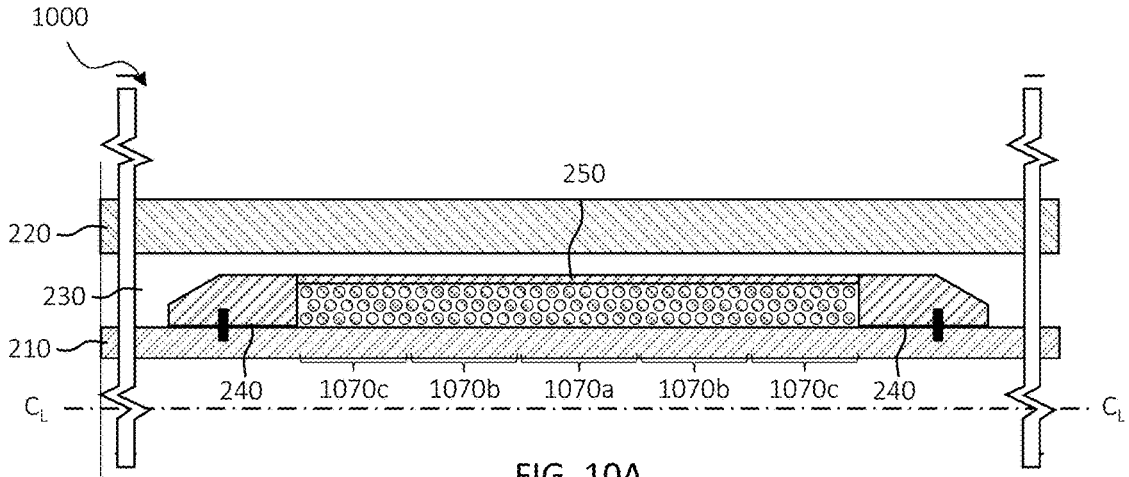
FIGS. 10A through 10E illustrate different deployment states for a downhole tool designed, manufactured, and operated according to one aspect of the disclosure.
Figure 10B:
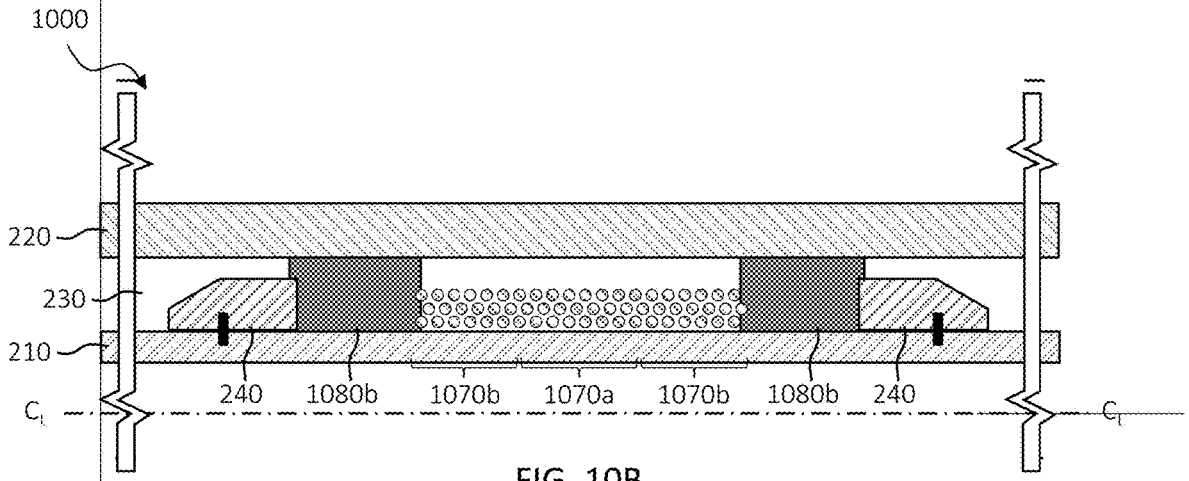
Figure 10C:
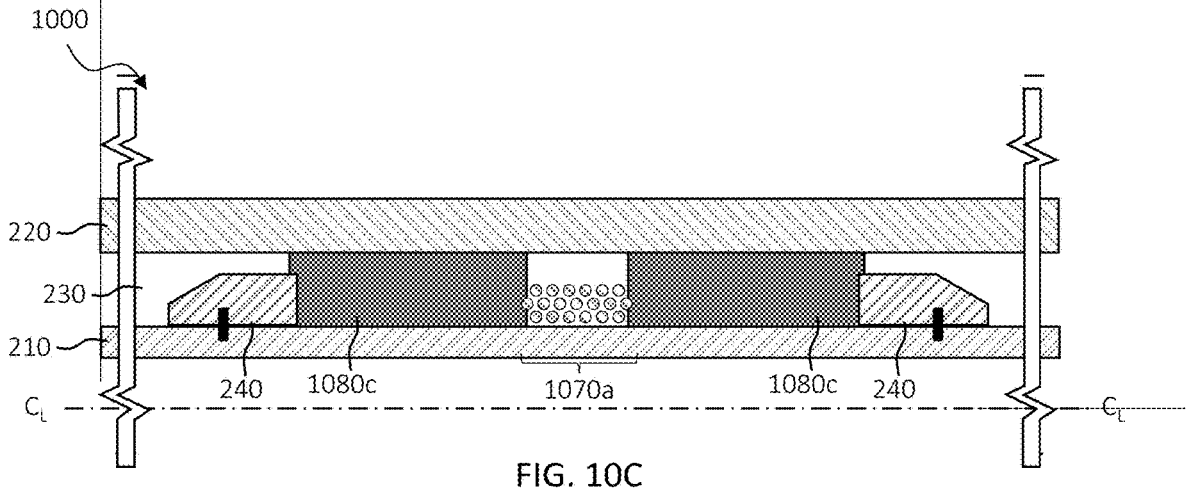
Figure 10D:
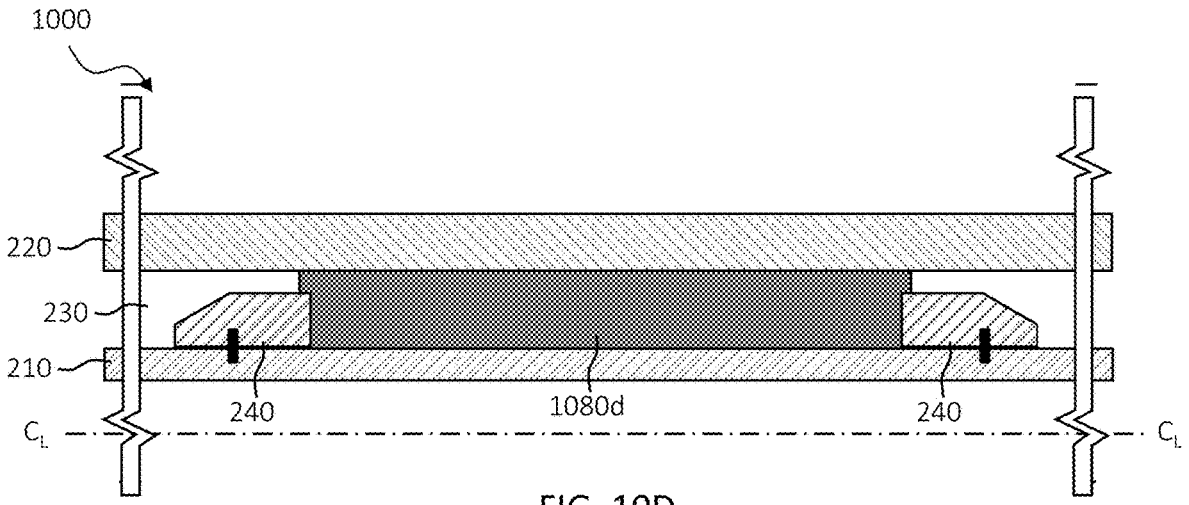
Figure 10E:
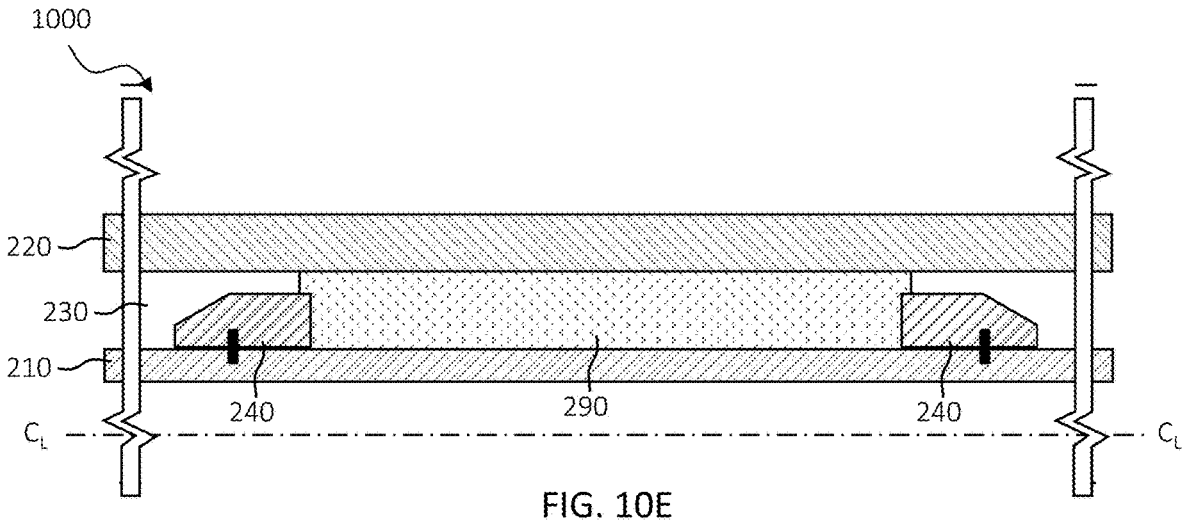

Turning now to FIGS. 10A through 10E, depicted are various different manufacturing states for a downhole tool 1000 designed, manufactured, and operated according to an alternative embodiment of the disclosure. FIG. 10A illustrates the downhole tool 1000 pre-expansion, FIG. 10B illustrates the downhole tool 1000 at an initial-stage of expansion, FIG. 10C illustrates the downhole tool 1000 at a mid-stage of expansion, FIG. 10D illustrates the downhole tool 1000 post-expansion, and FIG. 10E illustrates the downhole tool 1000 post-expansion and containing residual unreacted expandable metal therein. The downhole tool 1000 of FIGS. 10A through 10E is similar in many respects to the downhole tool 900 of FIGS. 9A through 9E. Accordingly, like reference numbers have been used to illustrate similar, if not identical, features. The downhole tool 1000 differs, for the most part, from the downhole tool 900, in that the third wire of expandable metal 1070*c* has the fastest reaction rate, the second wire of expanded metal 1070*b* has the second fasted reaction rate, and the first wire of expandable metal 1070*a* has the slowest reaction rate. Such is shown in FIGS. 10B through 10D with the expanded metal seal element 1080*b*, 1080*c*, 1080*d* incrementally expanding as each of the third, second and first wires of expandable metal 1070*c*, 1070*b*, 1070*a* expand in response to hydrolysis.

Figure 11A:
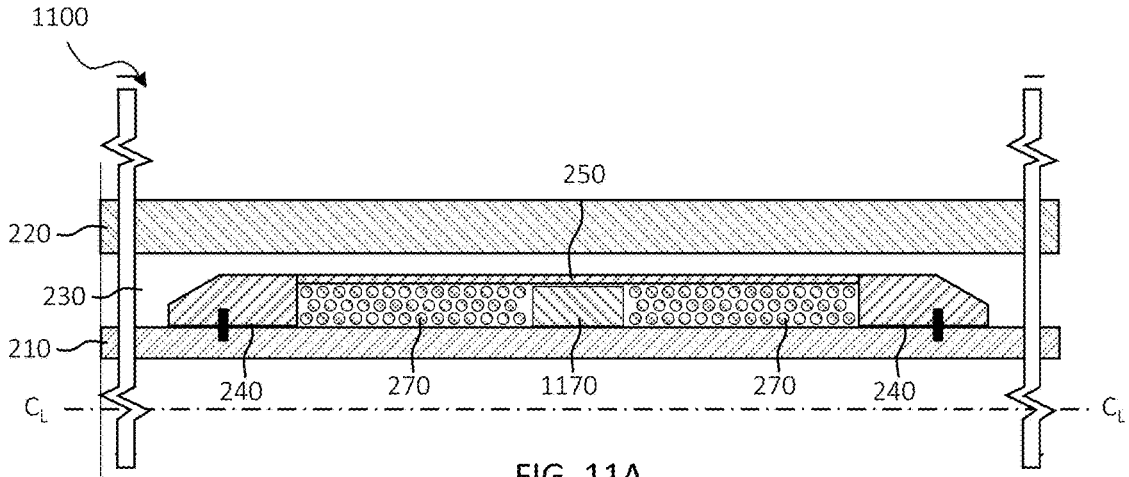
FIGS. 11A through 11D illustrate different deployment states for a downhole tool designed, manufactured, and operated according to one aspect of the disclosure.
Figure 11B:
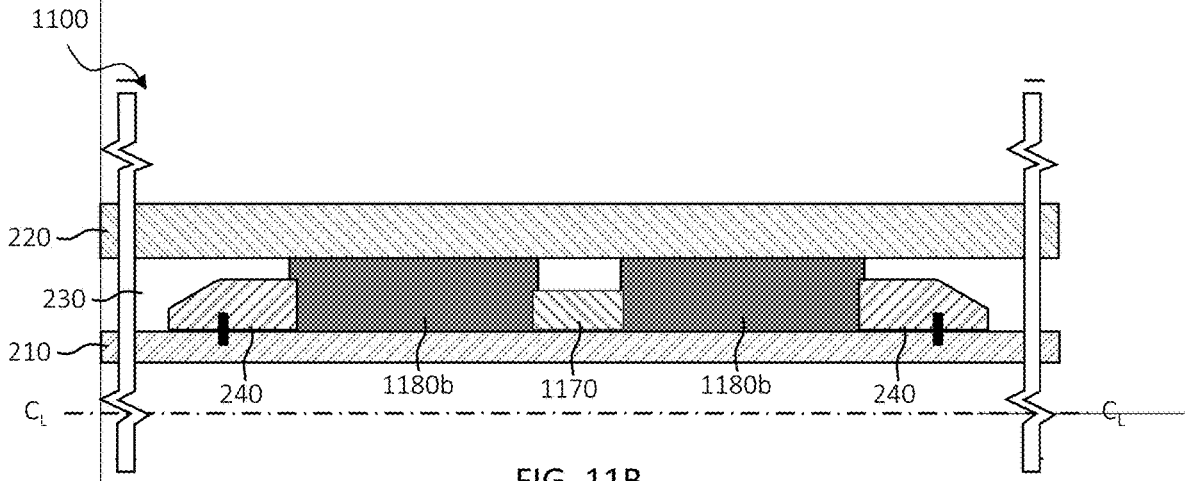
Figure 11C:
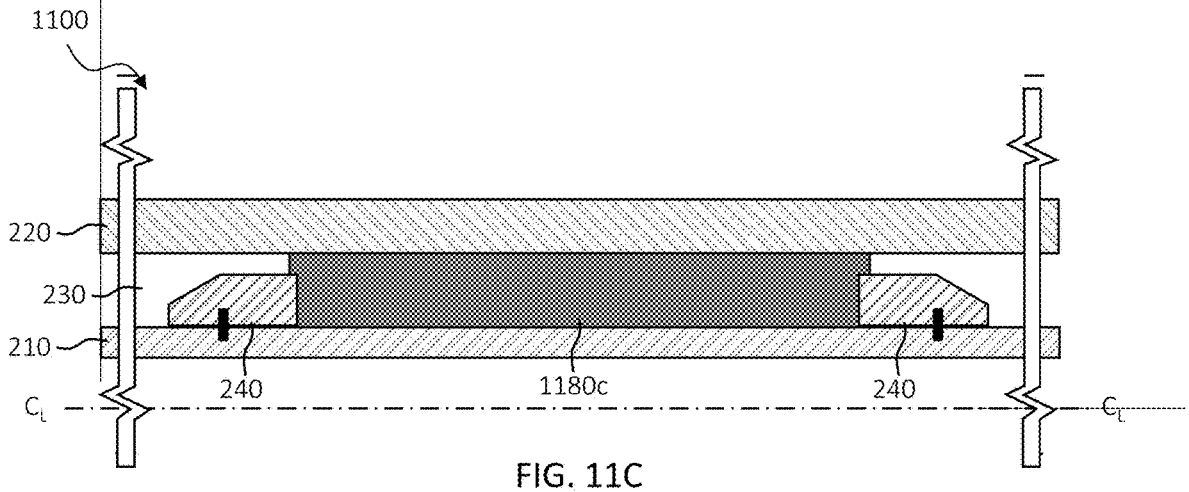
Figure 11D:
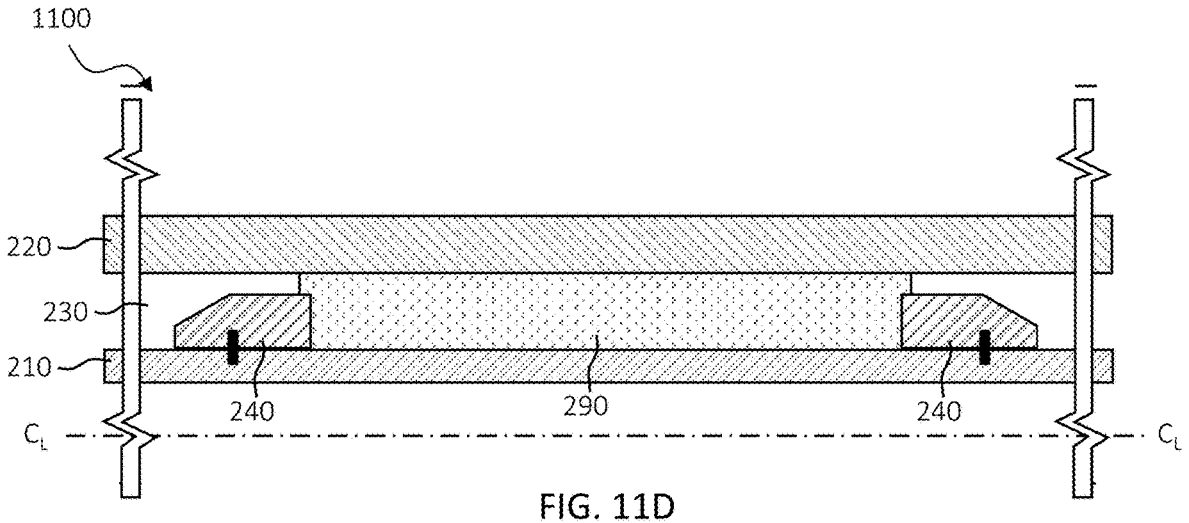

Turning now to FIGS. 11A through 11D, depicted are various different manufacturing states for a downhole tool 1100 designed, manufactured, and operated according to an alternative embodiment of the disclosure. FIG. 11A illustrates the downhole tool 1100 pre-expansion, FIG. 11B illustrates the downhole tool 1100 at an initial stage of expansion, FIG. 11C illustrates the downhole tool 1100 post-expansion, and FIG. 11D illustrates the downhole tool 1100 post-expansion and containing residual unreacted expandable metal therein. The downhole tool 1100 of FIGS. 11A through 11D is similar in many respects to the downhole tool 200 of FIGS. 2A through 2C. Accordingly, like reference numbers have been used to illustrate similar, if not identical, features. The downhole tool 1100 differs, for the most part, from the downhole tool 200, in that the downhole tool 1100 includes one or more second expandable metal seal elements 1170 placed about the tubular 210 proximate the one or more first expandable metal seal elements 270. In at least one embodiment, the one or more second expandable metal seal elements 1170 comprise the metal configured to expand in response to hydrolysis, but have a second surface-area-to-volume ratio (SA:V) of less than 1 $cm^{-1}$. In at least one other embodiment, the second surface-area-to-volume ratio (SA:V) is less than 0.1 $cm^{-1}$.

Figure 12A:
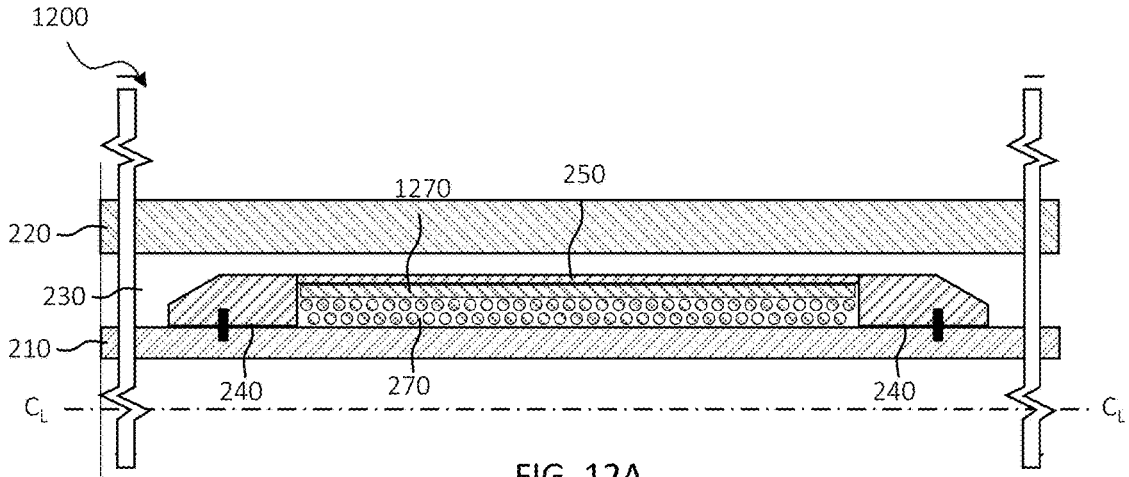
FIGS. 12A through 12D illustrate different deployment states for a downhole tool designed, manufactured, and operated according to one aspect of the disclosure.
Figure 12B:
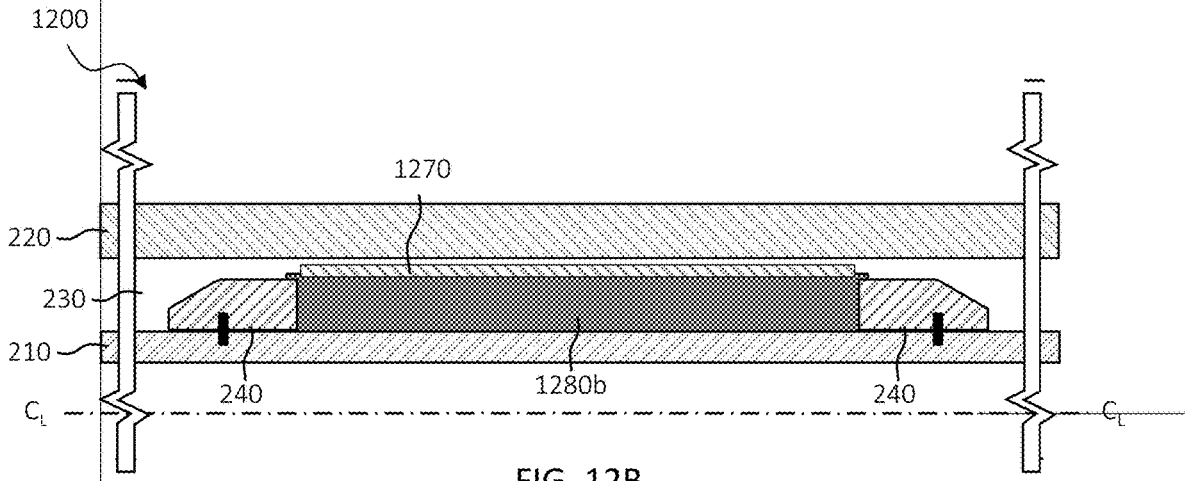
Figure 12C:
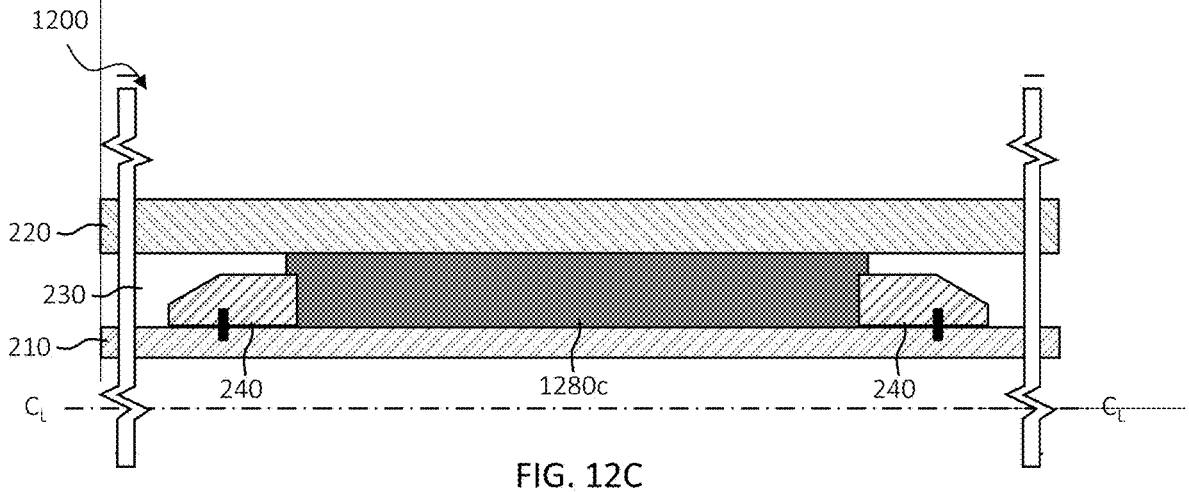
Figure 12D:
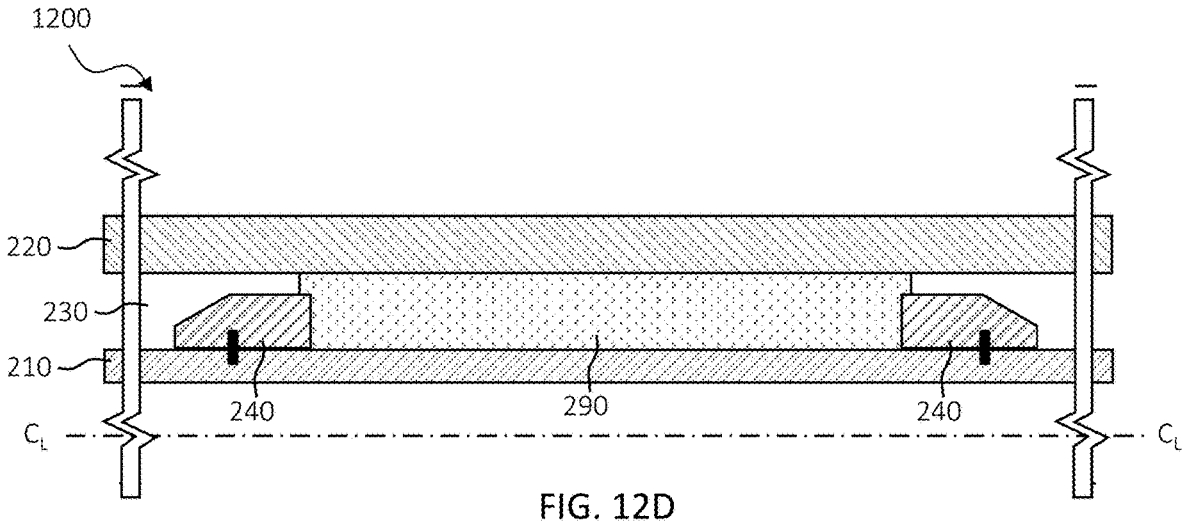

Turning now to FIGS. 12A through 12D, depicted are various different manufacturing states for a downhole tool 1200 designed, manufactured, and operated according to an alternative embodiment of the disclosure. FIG. 12A illustrates the downhole tool 1200 pre-expansion, FIG. 12B illustrates the downhole tool 1200 at an initial stage of expansion, FIG. 12C illustrates the downhole tool 1200 post-expansion, and FIG. 12D illustrates the downhole tool 1200 post-expansion and containing residual unreacted expandable metal therein. The downhole tool 1200 of FIGS. 12A through 12D is similar in many respects to the downhole tool 1100 of FIGS. 11A through 11D. Accordingly, like reference numbers have been used to illustrate similar, if not identical, features. The downhole tool 1200 differs, for the most part, from the downhole tool 1100, in that the downhole tool 1200 includes one or more second expandable metal seal elements 1270 placed about the one or more first expandable metal seal elements 270. In at least one embodiment, the one or more second expandable metal seal elements 1270 comprise the metal configured to expand in response to hydrolysis, but have a second surface-area-to-volume ratio (SA:V) of less than 1 $cm^{-1}$. In at least one other embodiment, the second surface-area-to-volume ratio (SA:V) is less than 0.1 $cm^{-1}$.

Figure 13A:
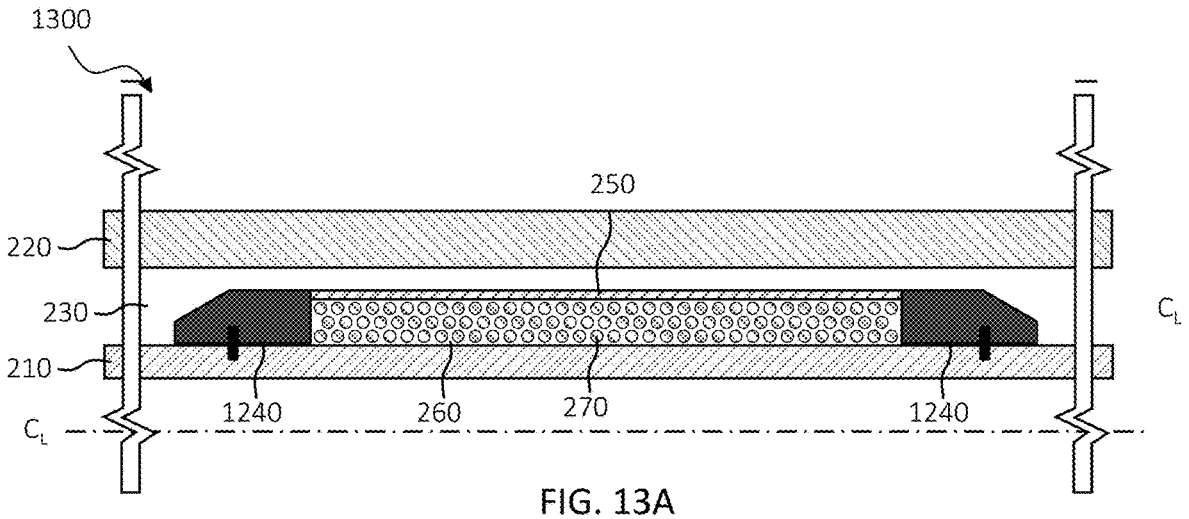
FIGS. 13A through 13D illustrate different deployment states for a downhole tool designed, manufactured, and operated according to one aspect of the disclosure.
Figure 13B:
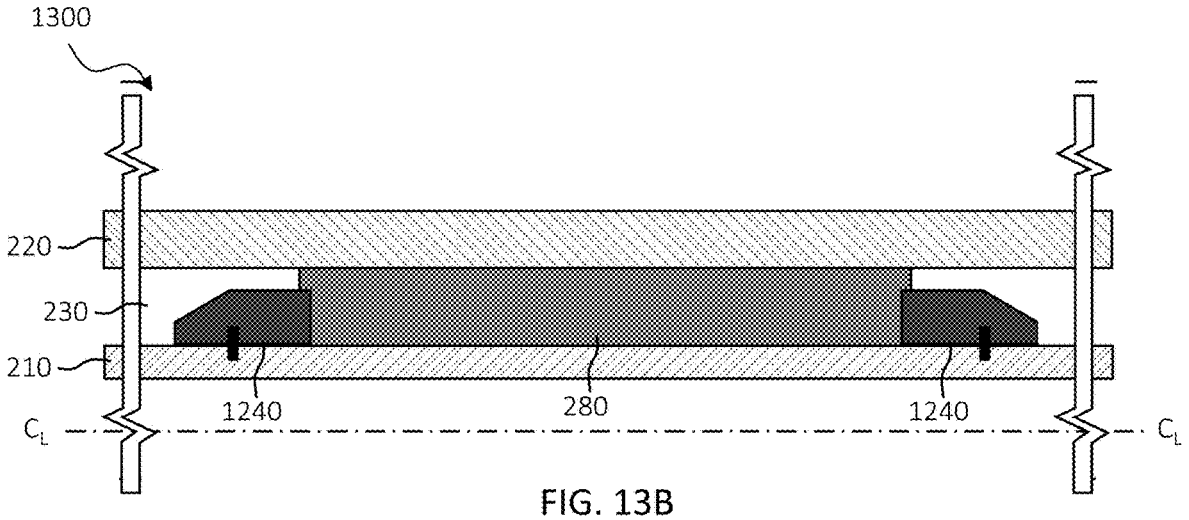
Figure 13C:
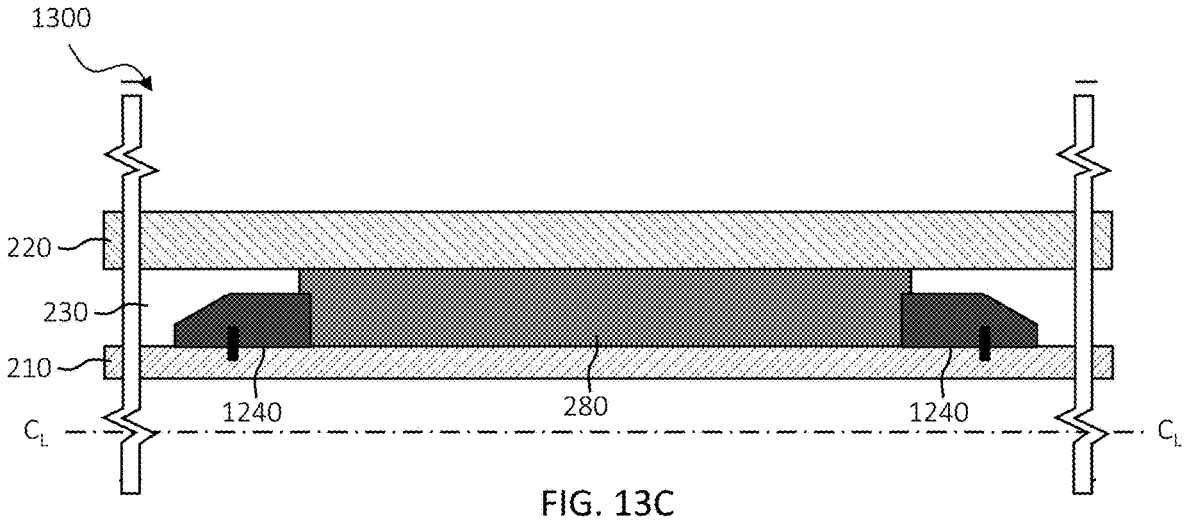
Figure 13D:
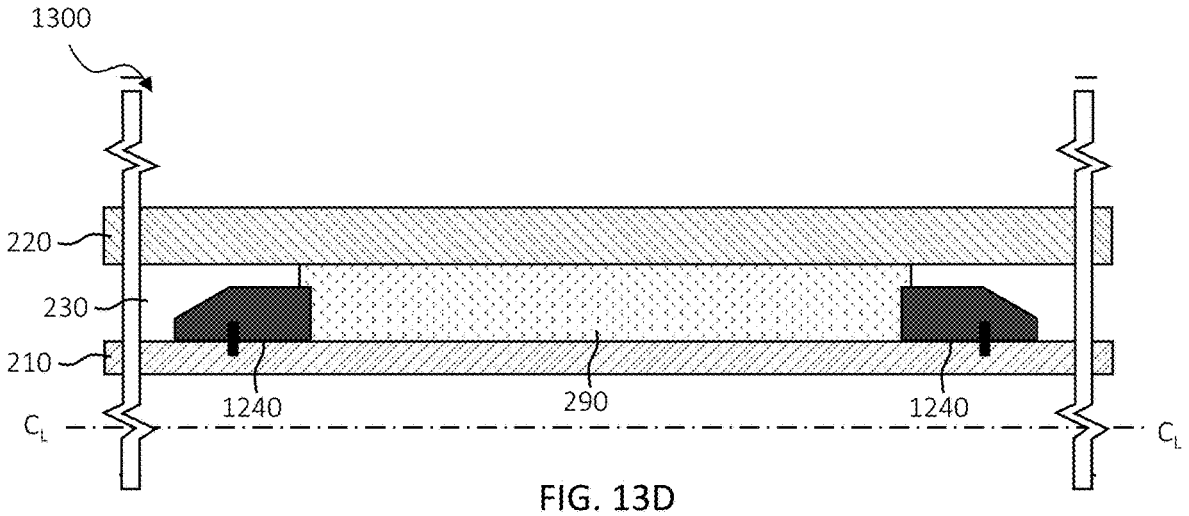

Turning now to FIGS. 13A through 13D, depicted are various different manufacturing states for a downhole tool 1300 designed, manufactured, and operated according to an alternative embodiment of the disclosure. FIG. 13A illustrates the downhole tool 1300 pre-expansion, FIG. 13B illustrates the downhole tool 1300 with the expandable metal post-expansion, FIG. 13C illustrates the downhole tool 1300 with the expandable metal post-expansion and the swellable elastomer post-expansion, and FIG. 13D illustrates the downhole tool 1300 with the expandable metal post-expansion and the swellable elastomer post-expansion and containing residual unreacted expandable metal therein. The downhole tool 1300 of FIGS. 13A through 13D is similar in many respects to the downhole tool 200 of FIGS. 2A through 2C. Accordingly, like reference numbers have been used to illustrate similar, if not identical, features. The downhole tool 1300 differs, for the most part, from the downhole tool 200, in that the downhole tool 1300 includes one or more swellable elastomers 1240 placed about the tubular 210. In the illustrated embodiment, the one or more swellable elastomers 1240 are located on either side of the one or more expandable metal seal elements 270, but they could be located anywhere. In the illustrated embodiment, the one or more swellable elastomers 1240 swell slower than the one or more expandable metal seal elements 270 expand.

Aspects disclosed herein include:

A. A downhole tool, the downhole tool including: 1) a tubular; and 2) one or more expandable metal seal elements placed about the tubular, the one or more expandable metal seal elements comprising a metal configured to expand in response to hydrolysis and having a surface-area-to-volume ratio (SA:V) of at least 2 $cm^{-1}$.

B. A method for sealing within a well system, the method including: 1) positioning a downhole tool within a wellbore extending toward a subterranean formation, the downhole tool including: a) a tubular; and b) one or more expandable metal seal elements placed about the tubular, the one or more expandable metal seal elements comprising a metal configured to expand in response to hydrolysis and having a surface-area-to-volume ratio (SA:V) of at least 2 $cm^{-1}$.; and 2) subjecting the one or more expandable metal seal elements to reactive fluid to form one or more expanded metal seal elements.

C. A well system, the well system including: 1) a wellbore extending toward a subterranean formation; 2) a conveyance positioned within the wellbore; and 3) a downhole tool coupled to the conveyance, the downhole tool including: a) a tubular; and b) one or more expandable metal seal elements placed about the tubular, the one or more expandable metal seal elements comprising a metal configured to expand in response to hydrolysis and having a surface-area-to-volume ratio (SA:V) of at least 2 $cm^{-1}$.

D. A downhole tool, the downhole tool including: 1) a tubular; and 2) a collection of individual separate chunks of expandable metal positioned about the tubular, the collection of individual separate chunks of expandable metal comprising a metal configured to expand in response to hydrolysis.

E. A method for sealing within a well system, the method including: 1) positioning a downhole tool within a wellbore extending toward a subterranean formation, the downhole tool including: a) a tubular; and b) a collection of individual separate chunks of expandable metal positioned about the tubular, the collection of individual separate chunks of expandable metal comprising a metal configured to expand in response to hydrolysis; and 2) subjecting the collection of individual separate chunks of expandable metal to reactive fluid to form one or more expanded metal seals.

F. A well system, the well system including: 1) a wellbore extending toward a subterranean formation; 2) a conveyance positioned within the wellbore; and 3) a downhole tool coupled to the conveyance, the downhole tool including: a) a tubular; and b) a collection of individual separate chunks of expandable metal positioned about the tubular, the collection of individual separate chunks of expandable metal comprising a metal configured to expand in response to hydrolysis.

Aspects A, B, C, D, E, and F may have one or more of the following additional elements in combination: Element 1: wherein the one or more expandable metal seal elements have a surface-area-to-volume ratio (SA:V) of at least 5 $cm^{-1}$. Element 2: wherein the one or more expandable metal seal elements have a surface-area-to-volume ratio (SA:V) of less than 100 $cm^{-1}$. Element 3: wherein the one or more expandable metal seal elements have a surface-area-to-volume ratio (SA:V) ranging from 5 $cm^{-1}$ to 50 $cm^{-1}$. Element 4: wherein the one or more expandable metal seal elements have a surface-area-to-volume ratio (SA:V) ranging from 10 $cm^{-1}$ to 20 $cm^{-1}$. Element 5: wherein the one or more expandable metal seal elements are one or more wires of expandable metal wrapped around the tubular. Element 6: wherein the one or more expandable metal seal elements are a first wire of expandable metal wrapped around the tubular and a second different wire of expandable metal wrapped around the first wire of expandable metal. Element 7: wherein the first wire has a first reaction rate, and the second different wire has a second different reaction rate. Element 8: wherein the first wire has the surface-area-to-volume ratio (SA:V) of at least 10 $cm^{-1}$ and the second different wire has a second lesser surface-area-to-volume ratio (SA:V), the second lesser surface-area-to-volume ratio (SA:V) causing the second different reaction rate to be slower than the first reaction rate. Element 9: wherein the first wire comprises a first expandable metal having the first reaction rate and the second different wire comprises a second different expandable metal having a second lesser reaction rate. Element 10: further including a sleeve covering the one or more expandable metal seal elements. Element 11: wherein the sleeve is a solid sleeve. Element 12: wherein the sleeve includes openings therein for allowing reactive fluid to contact the one or more expandable metal seal elements. Element 13: wherein the one or more expandable metal seal elements are a collection of individual separate chunks of expandable metal held in place by the sleeve. Element 14: wherein the collection of individual separate chunks of expandable metal comprises two or more different expandable metals. Element 15: wherein the collection of individual separate chunks of expandable metal comprises a plurality of different size chunks of the expandable metal. Element 16: wherein the sleeve comprises a metal configured to expand in response to hydrolysis. Element 17: wherein the one or more expandable metal seal elements are a plurality of axially stacked expandable metal seal elements. Element 18: wherein the one or more expandable metal seal elements are configured such that voids exist between adjacent portions of the one or more expandable metal seal elements. Element 19: further including at least partially filling the voids with a material configured to delay the hydrolysis. Element 20: further including at least partially filling the voids with a material configured to expedite the hydrolysis. Element 21: wherein the one or more expandable metal seal elements are one or more first expandable metal seal elements, and further including one or more second expandable metal seal elements placed about the tubular proximate the one or more first expandable metal seal elements, the one or more second expandable metal seal elements comprising the metal configured to expand in response to hydrolysis and having a second surface-area-to-volume ratio (SA:V) of less than 1 $cm^{-1}$. Element 22: wherein the second surface-area-to-volume ratio (SA:V) is less than 0.1 $cm^{-1}$. Element 23: wherein the collection of individual separate chunks of expandable metal have a surface-area-to-volume ratio (SA:V) of at least 2 $cm^{-1}$. Element 24: wherein the collection of individual separate chunks of expandable metal have a surface-area-to-volume ratio (SA:V) of at least 5 $cm^{-1}$. Element 25: wherein the collection of individual separate chunks of expandable metal have a surface-area-to-volume ratio (SA:V) of less than 100 $cm^{-1}$. Element 26: wherein the collection of individual separate chunks of expandable metal have a surface-area-to-volume ratio (SA:V) ranging from 5 $cm^{-1}$ to 50 $cm^{-1}$. Element 27: wherein the collection of individual separate chunks of the expandable metal are a collection of individual separate different sized chunks of expandable metal. Element 28: wherein a first volume of a largest of the collection of individual separate chunks of the expandable metal is at least 5 times a second volume of a smallest of the collection of individual separate chunks of the expandable metal. Element 29: wherein a first volume of a largest of the collection of individual separate chunks of the expandable metal is at least 50 times a second volume of a smallest of the collection of individual separate chunks of the expandable metal. Element 30: wherein the collection of individual separate chunks of the expandable metal are held together with a binding agent. Element 31: further including a surface positioned about the tubular, the tubular and the surface defining a space there between, and further wherein the collection of individual separate chunks of expandable metal are positioned in the space. Element 32: wherein the collection of individual separate chunks of expandable metal have a surface-area-to-volume ratio (SA:V) of at least 2 $cm^{-1}$. Element 33: wherein the collection of individual separate chunks of expandable metal have a surface-area-to-volume ratio (SA:V) of less than 100 $cm^{-1}$. Element 34: wherein the collection of individual separate chunks of the expandable metal are a collection of individual separate different sized chunks of expandable metal, wherein a first volume of a largest of the collection of individual separate chunks of the expandable metal is at least 5 times a second volume of a smallest of the collection of individual separate chunks of the expandable metal. Element 35: wherein a first volume of a largest of the collection of individual separate chunks of the expandable metal is at least 50 times a second volume of a smallest of the collection of individual separate chunks of the expandable metal. Element 36: further including a surface positioned about the tubular, the tubular and the surface defining a space there between, and further wherein the collection of individual separate chunks of expandable metal are positioned in the space. Element 37: wherein the collection of individual separate chunks of expandable metal have a surface-area-to-volume ratio (SA:V) of at least 5 $cm^{-1}$. Element 38: wherein the collection of individual separate chunks of expandable metal have a surface-area-to-volume ratio (SA:V) of less than 100 $cm^{-1}$. Element 39: wherein the collection of individual separate chunks of the expandable metal are a collection of individual separate different sized chunks of expandable metal, wherein a first volume of a largest of the collection of individual separate chunks of the expandable metal is at least 50 times a second volume of a smallest of the collection of individual separate chunks of the expandable metal. Element 40: further including a surface positioned about the tubular, the tubular and the surface defining a space there between, and further wherein the collection of individual separate chunks of expandable metal are positioned in the space.

Those skilled in the art to which this application relates will appreciate that other and further additions, deletions, substitutions, and modifications may be made to the described embodiments.

What is claimed is:

1. A downhole tool, comprising:

a tubular; and a collection of conductive individual separate chunks of expandable metal positioned about the tubular, the collection of conductive individual separate chunks of expandable metal comprising a metal configured to expand in response to hydrolysis, wherein the collection of conductive individual separate chunks of expandable metal each has a surface-area-to-volume ratio (SA:V) ranging from 5 $cm^{-1}$ to 50 $cm^{-1}$ and further wherein during the expansion, the separate chunks of expandable metal are configured to go from metal to micron-scale particles that are larger and lock together.

2. The downhole tool as recited in claim 1, wherein the collection of conductive individual separate chunks of the expandable metal are a collection of conductive individual separate different sized chunks of expandable metal.

3. The downhole tool as recited in claim 2, wherein a first volume of a largest of the collection of conductive individual separate chunks of the expandable metal is at least 5 times a second volume of a smallest of the collection of conductive individual separate chunks of the expandable metal.

4. The downhole tool as recited in claim 2, wherein a first volume of a largest of the collection of conductive individual separate chunks of the expandable metal is at least 50 times a second volume of a smallest of the collection of conductive individual separate chunks of the expandable metal.

5. The downhole tool as recited in claim 2, wherein the collection of conductive individual separate chunks of the expandable metal are held together with a binding agent.

6. The downhole tool as recited in claim 1, further including a surface positioned about the tubular, the tubular and the surface defining a space there between, and further wherein the collection of conductive individual separate chunks of expandable metal are positioned in the space.

7. A method for sealing within a well system, comprising:

positioning a downhole tool within a wellbore extending toward a subterranean formation, the downhole tool including:

a tubular; and a collection of individual separate chunks of expandable metal positioned about the tubular, the collection of individual separate chunks of expandable metal comprising a metal configured to expand in response to hydrolysis, wherein the collection of conductive individual separate chunks of expandable metal each has a surface-area-to-volume ratio (SA:V) ranging from 5 $cm^{-1}$ to 50 $cm^{-1}$, and further wherein during the expansion, the separate chunks of expandable metal are configured to go from metal to micron-scale particles that are larger and lock together; and subjecting the collection of individual separate chunks of expandable metal to reactive fluid to form one or more expanded metal seals.

8. The method as recited in claim 7, wherein the collection of individual separate chunks of the expandable metal are a collection of individual separate different sized chunks of expandable metal, wherein a first volume of a largest of the collection of individual separate chunks of the expandable metal is at least 5 times a second volume of a smallest of the collection of individual separate chunks of the expandable metal.

9. The method as recited in claim 8, wherein a first volume of a largest of the collection of individual separate chunks of the expandable metal is at least 50 times a second volume of a smallest of the collection of individual separate chunks of the expandable metal.

10. The method as recited in claim 9, further including a surface positioned about the tubular, the tubular and the surface defining a space there between, and further wherein the collection of individual separate chunks of expandable metal are positioned in the space.

11. A well system, comprising:

a wellbore extending toward a subterranean formation;

a conveyance positioned within the wellbore; and a downhole tool coupled to the conveyance, the downhole tool including:

a tubular; and a collection of conductive individual separate chunks of expandable metal positioned about the tubular, the collection of conductive individual separate chunks of expandable metal comprising a metal configured to expand in response to hydrolysis, wherein the collection of conductive individual separate chunks of expandable metal each has a surface-area-to-volume ratio (SA:V) ranging from 5 $cm^{-1}$ to 50 $cm^{-1}$, and further wherein during the expansion, the separate chunks of expandable metal are configured to go from metal to micron-scale particles that are larger and lock together.

12. The well system as recited in claim 11, wherein the collection of conductive individual separate chunks of the expandable metal are a collection of conductive individual separate different sized chunks of expandable metal, wherein a first volume of a largest of the collection of conductive individual separate chunks of the expandable metal is at least 50 times a second volume of a smallest of the collection of conductive individual separate chunks of the expandable metal.

13. The well system as recited in claim 11, further including a surface positioned about the tubular, the tubular and the surface defining a space there between, and further wherein the collection of conductive individual separate chunks of expandable metal are positioned in the space.

* * * * *